US012582156B2

(12) United States Patent
Grishchenko

(10) Patent No.: US 12,582,156 B2
(45) Date of Patent: Mar. 24, 2026

(54) ARTICLE FOR USE IN A NON-COMBUSTIBLE AEROSOL PROVISION SYSTEM

(71) Applicant: NICOVENTURES TRADING LIMITED, London (GB)

(72) Inventor: Andrei Grishchenko, London (GB)

(73) Assignee: NICOVENTURES TRADING LIMITED, London (GB)

( * ) Notice: Subject to any disclaimer, the term of this patent is extended or adjusted under 35 U.S.C. 154(b) by 687 days.

(21) Appl. No.: 17/596,300

(22) PCT Filed: Jun. 11, 2020

(86) PCT No.: PCT/GB2020/051412
§ 371 (c)(1),
(2) Date: Dec. 7, 2021

(87) PCT Pub. No.: WO2020/249954
PCT Pub. Date: Dec. 17, 2020

(65) Prior Publication Data

US 2022/0304369 A1 Sep. 29, 2022

(30) Foreign Application Priority Data

Jun. 11, 2019 (GB) ..... 1908356

(51) Int. Cl.
*A24D 1/20* (2020.01)
*A24D 1/04* (2006.01)
(Continued)

(52) U.S. Cl.
CPC ..... *A24D 1/20* (2020.01); *A24D 1/04* (2013.01); *A24D 3/0216* (2013.01); *A24D 3/061* (2013.01); *A24D 3/17* (2020.01)

(58) Field of Classification Search
None
See application file for complete search history.

(56) References Cited

U.S. PATENT DOCUMENTS 3,008,473 A 11/1961 Touey
3,202,155 A 8/1965 Caines et al.
(Continued)

FOREIGN PATENT DOCUMENTS

AU 2020293009 B2 11/2023
BR PI05115892 A2 1/2008
(Continued)

OTHER PUBLICATIONS

"Acetate Tow" , Available at <https://web.archive.org/web/20170505 175813/https://www.celanese.com/cellulose-derivatives/products/Acetate-Tow.aspx> , May 5, 2017 , 3 Pages.
(Continued)

*Primary Examiner* — Michael H. Wilson
*Assistant Examiner* — Michael T Fulton
(74) *Attorney, Agent, or Firm* — Merchant & Gould P.C.

(57) ABSTRACT

An article for use in a non-combustible aerosol provision system is described. The article includes an aerosol generating material and a mouthpiece connected to the aerosol generating material, the mouthpiece including a first body of material, and a second body of material downstream of the first body. The second body is offset from the first body so as to define a cavity between the first body and the second body. A breakable capsule is disposed in the cavity, and a diameter of the capsule can be less than the length of the cavity and the diameter of the cavity can be greater than the length of the cavity. A method of manufacturing an article is also described.

21 Claims, 8 Drawing Sheets

(51) Int. Cl.

| | |
|---|---|
| ***A24D 3/02*** | (2006.01) |
| ***A24D 3/06*** | (2006.01) |
| ***A24D 3/17*** | (2020.01) |

(56) References Cited

U.S. PATENT DOCUMENTS

| | | | | |
|---|---|---|---|---|
| 3,498,299 | A | 3/1970 | White | |
| 3,648,712 | A | 3/1972 | Patterson | |
| 3,752,166 | A | 8/1973 | Lyon et al. | |
| 3,800,676 | A | 4/1974 | Levers et al. | |
| 3,861,404 | A | 1/1975 | Changani | |
| 3,882,878 | A | 5/1975 | Sawada et al. | |
| 3,968,804 | A | 7/1976 | Kelly et al. | |
| 4,153,064 | A | 5/1979 | Sawada et al. | |
| 4,481,960 | A | 11/1984 | Brooks | |
| 4,522,616 | A | 6/1985 | Hyde et al. | |
| 4,646,762 | A | 3/1987 | Riehl et al. | |
| 4,807,647 | A | 2/1989 | Hayes | |
| 4,961,415 | A | 10/1990 | Radwanski et al. | |
| 5,063,945 | A | 11/1991 | Sugihara et al. | |
| 5,678,577 | A | 10/1997 | Matsumura et al. | |
| 5,685,323 | A | 11/1997 | Crooks et al. | |
| 5,690,127 | A | 11/1997 | Chapman et al. | |
| 5,711,322 | A | 1/1998 | Tsugaya et al. | |
| 5,787,902 | A | 8/1998 | Shepherd et al. | |
| 5,823,201 | A | 10/1998 | Matsumura | |
| 5,947,126 | A | 9/1999 | Wilson et al. | |
| 5,954,059 | A | 9/1999 | Beven et al. | |
| 6,924,029 | B1 | 8/2005 | Caenen et al. | |
| 9,185,935 | B2 | 11/2015 | Lewis et al. | |
| 11,019,842 | B2 | 6/2021 | Dube et al. | |
| 11,246,341 | B2 | 2/2022 | Han et al. | |
| 2002/0189625 | A1 | 12/2002 | Bushby et al. | |
| 2006/0174901 | A1 | 8/2006 | Karles et al. | |
| 2006/0231113 | A1 | 10/2006 | Newbery et al. | |
| 2007/0012327 | A1 | 1/2007 | Karles et al. | |
| 2007/0119466 | A1 | 5/2007 | Bilivitin et al. | |
| 2007/0181140 | A1 | 8/2007 | Xue et al. | |
| 2008/0029114 | A1 | 2/2008 | Seitert et al. | |
| 2008/0163877 | A1 | 7/2008 | Zhuang et al. | |
| 2008/0210225 | A1 | 9/2008 | Geiger | |
| 2008/0216848 | A1 | 9/2008 | Li et al. | |
| 2011/0041861 | A1 | 2/2011 | Sebastian et al. | |
| 2011/0083686 | A1 | 4/2011 | Yang et al. | |
| 2011/0108044 | A1 | 5/2011 | Norman et al. | |
| 2011/0162667 | A1 | 7/2011 | Burke et al. | |
| 2011/0271968 | A1* | 11/2011 | Carpenter | A24D 3/048 131/342 |
| 2012/0006346 | A1 | 1/2012 | Inagaki | |
| 2012/0103352 | A1 | 5/2012 | Taniguchi et al. | |
| 2012/0234821 | A1 | 9/2012 | Shimizu | |
| 2012/0255569 | A1 | 10/2012 | Beard et al. | |
| 2013/0037041 | A1 | 2/2013 | Worm et al. | |
| 2013/0112214 | A1 | 5/2013 | Bundren et al. | |
| 2014/0026908 | A1 | 1/2014 | Motodamari et al. | |
| 2014/0026909 | A1 | 1/2014 | Sebastian | |
| 2014/0026910 | A1 | 1/2014 | Bundren et al. | |
| 2014/0026911 | A1 | 1/2014 | Bundren et al. | |
| 2014/0096783 | A1 | 4/2014 | Sebastian et al. | |
| 2014/0103099 | A1 | 4/2014 | Snow et al. | |
| 2014/0261475 | A1 | 9/2014 | Kizer et al. | |
| 2015/0036454 | A1 | 2/2015 | Vosskuhl et al. | |
| 2015/0059788 | A1 | 3/2015 | Brown et al. | |
| 2015/0090282 | A1 | 4/2015 | Lewis et al. | |
| 2015/0208721 | A1 | 7/2015 | Thomas et al. | |
| 2015/0257448 | A1 | 9/2015 | Lord | |
| 2015/0296874 | A1 | 10/2015 | Awty et al. | |
| 2015/0335071 | A1 | 11/2015 | Brinkley et al. | |
| 2015/0374938 | A1 | 12/2015 | Scheiber et al. | |
| 2016/0037824 | A1 | 2/2016 | Jordil | |
| 2016/0106147 | A1 | 4/2016 | Lisan et al. | |
| 2016/0128378 | A1 | 5/2016 | Kuersteiner et al. | |
| 2016/0157521 | A1 | 6/2016 | Woodcock et al. | |
| 2016/0206004 | A1 | 7/2016 | Shinkawa et al. | |
| 2016/0219930 | A1 | 8/2016 | Reed et al. | |
| 2016/0295914 | A1 | 10/2016 | Jordil et al. | |
| 2016/0309782 | A1* | 10/2016 | Malgat | A24D 1/20 |
| 2016/0331032 | A1 | 11/2016 | Malgat et al. | |
| 2017/0042219 | A1 | 2/2017 | Delaloye et al. | |
| 2017/0238611 | A1 | 8/2017 | Buchberger | |
| 2018/0007972 | A1 | 1/2018 | Thorens | |
| 2018/0007974 | A1 | 1/2018 | Thorens | |
| 2018/0011037 | A1 | 1/2018 | Koseoglu et al. | |
| 2018/0027870 | A1 | 2/2018 | Kadiric et al. | |
| 2018/0064162 | A1 | 3/2018 | Fujita | |
| 2018/0271143 | A1 | 9/2018 | Besso | |
| 2018/0272260 | A1 | 9/2018 | Robertson et al. | |
| 2018/0325166 | A1 | 11/2018 | Delgado et al. | |
| 2018/0343919 | A1 | 12/2018 | Gitman et al. | |
| 2019/0045838 | A1 | 2/2019 | Nappi et al. | |
| 2019/0059442 | A1 | 2/2019 | Uthurry | |
| 2019/0075842 | A1 | 3/2019 | Caenen | |
| 2019/0174819 | A1 | 6/2019 | England et al. | |
| 2019/0297937 | A1 | 10/2019 | Guyard et al. | |
| 2020/0029616 | A1 | 1/2020 | Uthurry | |
| 2020/0281261 | A1 | 9/2020 | Yamauchi et al. | |
| 2021/0000168 | A1 | 1/2021 | Seo et al. | |
| 2021/0177065 | A1 | 6/2021 | Lee | |
| 2021/0315264 | A1 | 10/2021 | Lord et al. | |
| 2022/0015414 | A1 | 1/2022 | Uthurry | |
| 2022/0125101 | A1 | 4/2022 | Hepworth et al. | |
| 2022/0167661 | A1 | 6/2022 | Phillips et al. | |
| 2022/0183347 | A1 | 6/2022 | Hepworth et al. | |
| 2022/0183350 | A1 | 6/2022 | England et al. | |
| 2022/0183351 | A1 | 6/2022 | Forster et al. | |

FOREIGN PATENT DOCUMENTS

| | | | |
|---|---|---|---|
| CN | 1200899 | A | 12/1998 |
| CN | 1289234 | A | 3/2001 |
| CN | 102333461 | A | 1/2012 |
| CN | 102481021 | A | 5/2012 |
| CN | 102655771 | A | 9/2012 |
| CN | 102821627 | A | 12/2012 |
| CN | 102948924 | A | 3/2013 |
| CN | 104039180 | A | 9/2014 |
| CN | 104287089 | A | 1/2015 |
| CN | 204120211 | U | 1/2015 |
| CN | 104363779 | A | 2/2015 |
| CN | 104594128 | A | 5/2015 |
| CN | 104768402 | A | 7/2015 |
| CN | 104853629 | A | 8/2015 |
| CN | 104869854 | A | 8/2015 |
| CN | 105050435 | A | 11/2015 |
| CN | 105813483 | A | 7/2016 |
| CN | 106998798 | A | 8/2017 |
| CN | 108113051 | A | 6/2018 |
| CN | 108366614 | A | 8/2018 |
| CN | 108601394 | A | 9/2018 |
| CN | 207803436 | U | 9/2018 |
| CN | 109219359 | A | 1/2019 |
| CN | 109393576 | A | 3/2019 |
| CN | 109414058 | A | 3/2019 |
| DE | 2362701 | B2 | 9/1977 |
| DE | 602004012296 | | 4/2008 |
| DK | 159042 | B | 8/1990 |
| EP | 539191 | B1 | 7/1995 |
| EP | 2520186 | A1 | 11/2012 |
| EP | 2856891 | A1 | 4/2015 |
| EP | 2893820 | A1 | 7/2015 |
| EP | 2932860 | A1 | 10/2015 |
| EP | 3258798 | A1 | 12/2017 |
| EP | 3391758 | A1 | 10/2018 |
| EP | 3236786 | B1 | 11/2018 |
| EP | 3494809 | A1 | 6/2019 |
| EP | 3076815 | B1 | 2/2020 |
| GB | 1228260 | A | 4/1971 |
| GB | 1403478 | A | 8/1975 |
| GB | 1406748 | A | 9/1975 |
| GB | 1457694 | A | 12/1976 |
| GB | 2075328 | A | 11/1981 |
| GB | 2139869 | A | 11/1984 |
| GB | 2461858 | A | 1/2010 |
| GB | 2490730 | A | 11/2012 |

(56) References Cited

FOREIGN PATENT DOCUMENTS

| | | | |
|---|---|---|---|
| GB | 2549803 | A | 11/2017 |
| JP | S4826995 | U | 3/1973 |
| JP | S4990194 | U | 8/1974 |
| JP | H01246454 | A | 10/1989 |
| JP | H02242663 | A | 9/1990 |
| JP | H05211861 | A | 8/1993 |
| JP | H05219931 | A | 8/1993 |
| JP | 2007520204 | A | 7/2007 |
| JP | 2009502194 | A | 1/2009 |
| JP | 2012519550 | | 8/2012 |
| JP | 2013511265 | A | 4/2013 |
| JP | 5247711 | B2 | 7/2013 |
| JP | 2014509872 | A | 4/2014 |
| JP | 2014513538 | A | 6/2014 |
| JP | 2014525237 | A | 9/2014 |
| JP | 2015508992 | A | 3/2015 |
| JP | 2015530082 | A | 10/2015 |
| JP | 2016514472 | A | 5/2016 |
| JP | 2016528874 | A | 9/2016 |
| JP | 2016195585 | A | 11/2016 |
| JP | 2017502652 | | 1/2017 |
| JP | 2017536851 | A | 12/2017 |
| JP | 2018501818 | A | 1/2018 |
| JP | 2018505687 | A | 3/2018 |
| JP | 2018057403 | A | 4/2018 |
| JP | 2018509897 | A | 4/2018 |
| JP | 2018514215 | | 6/2018 |
| JP | 6371927 | | 8/2018 |
| JP | 2018529347 | A | 10/2018 |
| JP | 2018192131 | | 12/2018 |
| JP | 2019503659 | A | 2/2019 |
| JP | 2019503676 | A | 2/2019 |
| JP | 7440194 | B2 | 2/2024 |
| KR | 20130029062 | A | 3/2013 |
| KR | 20180069092 | A | 6/2018 |
| KR | 20190015873 | A | 2/2019 |
| RO | 201700023 | U2 | 8/2018 |
| RU | 138230 | U1 | 3/2014 |
| RU | 143582 | U1 | 7/2014 |
| RU | 2604313 | C2 | 12/2016 |
| RU | 2639117 | C1 | 12/2017 |
| RU | 2672657 | C2 | 11/2018 |
| RU | 2674975 | C1 | 12/2018 |
| TW | 143535 | B | 10/1990 |
| TW | 201731397 | A | 9/2017 |
| WO | 0232238 | A2 | 4/2002 |
| WO | WO 2007/010407 | A2 | 1/2007 |
| WO | 2009122434 | A2 | 10/2009 |
| WO | 2010047389 | A1 | 4/2010 |
| WO | 2010108139 | A1 | 9/2010 |
| WO | 2011148126 | A1 | 12/2011 |
| WO | 2012076649 | A1 | 6/2012 |
| WO | 2013179428 | A1 | 12/2013 |
| WO | 2014072735 | A1 | 5/2014 |
| WO | 2014080516 | A1 | 5/2014 |
| WO | 2014140273 | A2 | 9/2014 |
| WO | 2014198815 | A1 | 12/2014 |
| WO | 2015036454 | A1 | 3/2015 |
| WO | 2015046420 | A1 | 4/2015 |
| WO | WO-2015091792 | A1 | 6/2015 |
| WO | 2016023965 | A1 | 2/2016 |
| WO | 2017021994 | A1 | 2/2017 |
| WO | 2017102633 | A1 | 6/2017 |
| WO | 2017148773 | A1 | 9/2017 |
| WO | 2017198837 | A1 | 11/2017 |
| WO | 2017198874 | A1 | 11/2017 |
| WO | 2017198876 | A1 | 11/2017 |
| WO | 2017207443 | A1 | 12/2017 |
| WO | 2017207586 | A1 | 12/2017 |
| WO | 2018011037 | A2 | 1/2018 |
| WO | 2018019855 | A1 | 2/2018 |
| WO | 2018050613 | A1 | 3/2018 |
| WO | 2018073376 | A1 | 4/2018 |
| WO | 2018182322 | A1 | 10/2018 |
| WO | 2018185014 | A1 | 10/2018 |
| WO | 2018215781 | A1 | 11/2018 |
| WO | 2019002377 | A1 | 1/2019 |
| WO | 2019003166 | A1 | 1/2019 |
| WO | 2019064019 | A1 | 4/2019 |
| WO | 2019081881 | A1 | 5/2019 |
| WO | 2019106038 | A1 | 6/2019 |
| WO | 2019130155 | A1 | 7/2019 |
| WO | 2020002910 | A1 | 1/2020 |

OTHER PUBLICATIONS

"Decision of Refusal received for Japanese Patent Application No. 2021-554577, mailed on Apr. 11, 2023".
"Decision of Refusal received for Japanese Patent Application No. 2021-554582, mailed on Apr. 11, 2023".
"Decision of Rejection received for Chinese Patent Application No. 202080048794.2, mailed on Apr. 7, 2024".
"U.S. Appl. No. 17/438,230, filed Jan. 20, 2022".
"U.S Application No. 17/438,183, filed Nov. 10, 2021".
"International Preliminary Report on Patentability received for PCT Patent Application No. PCT/EP2019/055179, mailed on Sep. 17, 2020".
"International Preliminary Report on Patentability received for PCT Patent Application No. PCT/GB2020/050598, mailed on Sep. 23, 2021".
"International Preliminary Report on Patentability received for PCT Patent Application No. PCT/GB2020/050600, mailed on Sep. 23, 2021".
"International Preliminary Report on Patentability received for PCT Patent Application No. PCT/GB2020/050593, mailed on Sep. 23, 2021".
"International Preliminary Report on Patentability received for PCT Patent Application No. PCT/GB2020/050603, mailed on Sep. 23, 2021".
"International Preliminary Report on Patentability received for PCT Patent Application No. PCT/GB2020/051407, mailed on Dec. 23, 2021".
"International Preliminary Report on Patentability received for PCT Patent Application No. PCT/GB2020/051410, mailed on Dec. 23, 2021".
"International Preliminary Report on Patentability received for PCT Patent Application No. PCT/GB2020/051412, mailed on Dec. 23, 2021".
"International Preliminary Report on Patentability received for PCT Patent Application No. PCT/GB2020/051976, mailed on Mar. 3, 2022".
"International Search Report and Written Opinion received for Application No. PCT/EP2019/055179, mailed on May 23, 2019".
"International Search Report and Written Opinion received for PCT Patent Application No. PCT/GB2020/050598, mailed on Jun. 23, 2020".
"International Search Report and Written Opinion received for PCT Patent Application No. PCT/GB2020/050600, mailed on Jun. 24, 2020".
"International Search Report and Written Opinion received for PCT Patent Application No. PCT/GB2020/050593, mailed on Jun. 22, 2020".
"International Search Report and Written Opinion received for PCT Patent Application No. PCT/GB2020/050603, mailed on Jun. 16, 2020".
"International Search Report and Written Opinion received for PCT Patent Application No. PCT/GB2020/051407, mailed on Nov. 9, 2020".
"International Search Report and Written Opinion received for PCT Patent Application No. PCT/GB2020/051410, mailed on Jan. 21, 2021".
"International Search Report and Written Opinion received for PCT Patent Application No. PCT/GB2020/051976, mailed on Feb. 2, 2021".
"Invitation to Pay Additional Fees received for PCT Patent Application No. PCT/GB2020/051410, mailed on Nov. 10, 2020".
"Invitation to Pay Additional Fees received for PCT Patent Application No. PCT/GB2020/051976, mailed on Dec. 1, 2020".

(56) References Cited

OTHER PUBLICATIONS

"Notice of Reason for Rejection received for Japanese Patent Application No. 2021-554582, mailed on Nov. 15, 2022".
"Notice of Reasons for Refusal received for Japanese Patent Application No. 2021-554576, mailed on Jul. 25, 2023".
"Notice of Reasons for Rejection received for Japanese Patent Application No. 2021-554577, mailed on Dec. 13, 2022".
"Notice of Reasons for Rejection received for Japanese Patent Application No. 2021-554573, mailed on Dec. 13, 2022".
"Office Action received for Brazil Patent Application No. 112021018022-2, mailed on Mar. 19, 2024".
"Office Action received for Brazilian Patent Application No. 112021018009-5, mailed on May 28, 2024".
"Office Action received for Brazilian Patent Application No. 112021024839-0, mailed on May 6, 2024".
"Office Action received for Canadian Patent Application No. 3,132,883, mailed on May 17, 2024".
"Office Action received for Canadian Patent Application No. 3,132,887, mailed on Jan. 9, 2023".
"Office Action received for Canadian Patent Application No. 3,133,064, mailed on Aug. 10, 2023".
"Office Action received for Canadian Patent Application No. 3,142,652, mailed on Feb. 26, 2024".
"Office Action received for Canadian Patent Application No. 3,142,652, mailed on Jan. 30, 2024".
"Office Action received for Chinese Application No. 202080034029.5, mailed on Apr. 7, 2023".
"Office Action received for Chinese Application No. 202080034747.2, mailed on Apr. 10, 2023".
"Office Action received for Chinese Application No. 202080048794.2, mailed on May 17, 2023".
"Office Action received for Chinese Patent Application No. 202080035011.7, mailed on Feb. 22, 2023".
"Office Action received for Israeli Patent Application No. 288369, mailed on May 12, 2024".
"Office Action received for Korean Patent Application No. 10-2022-7000683, mailed on Jun. 20, 2024".
"Office Action received for Malaysian Patent Application No. PI2021007176, mailed on May 28, 2024".
"Office Action received for Russian Patent Application No. 2020128821 mailed on May 31, 2021".
"Reasons for Rejection received for Japanese Patent Application No. 2021-572884, mailed on Feb. 28, 2023".
International Search Report and Written Opinion for Application No. PCT/GB2020/051412, mailed on Sep. 9, 2020, 10 pages.
Reasons for refusal received for Japanese Patent Application No. 2023-196861, mailed on Sep. 10, 2024.
Notice of Reasons for Refusal received for Japanese Patent Application No. 2021-554582, dated Oct. 29, 2024, 72 pages with English Translation.
Office Action from Canadian Patent Application No. 3150559, dated Feb. 26, 2025, 7 pages.
Office Action in Korean Patent Application No. 10-2022-7000683, dated Feb. 25, 2025, 14 pages.
Reasons for Rejection for Korean Patent Application No. 10-2021-7040347, dated Dec. 26, 2024.

* cited by examiner

ARTICLE FOR USE IN A NON-COMBUSTIBLE AEROSOL PROVISION SYSTEM

PRIORITY CLAIM

The present application is a National Phase entry of PCT Application No. PCT/GB2020/051412, filed Jun. 11, 2020, which claims priority from GB Patent Application No. 1908356.7, filed Jun. 11, 2019, each of which is hereby fully incorporated herein by reference.

TECHNICAL FIELD

The present disclosure relates to an article for use in a non-combustible aerosol provision system, a non-combustible aerosol provision system including an article, and a method of manufacturing an article for use in a non-combustible aerosol provision system.

BACKGROUND

Certain tobacco industry products produce an aerosol during use, which is inhaled by a user. For example, tobacco heating devices heat an aerosol generating substrate such as tobacco to form an aerosol by heating, but not burning, the substrate. Such tobacco industry products commonly include mouthpieces through which the aerosol passes to reach the user's mouth.

SUMMARY

In accordance with embodiments of the disclosure, in a first aspect there is provided an article for use in a non-combustible aerosol provision system, the article comprising an aerosol generating material; and a mouthpiece connected to the aerosol generating material, the mouthpiece comprising: a first body of material; a second body of material downstream of the first body, wherein the second body is offset from the first body so as to define a cavity between the first body and the second body; and a breakable capsule disposed in the cavity, wherein a diameter of the capsule is less than the length of the cavity, and wherein the diameter of the cavity is greater than the length of the cavity.

In accordance with embodiments of the disclosure, in a second aspect there is provided a system comprising an article according to the first aspect, and a non-combustible aerosol provision device for heating the aerosol generating material of the article.

In accordance with embodiments of the disclosure, in a third aspect there is provided a method of manufacturing an article for use in a non-combustible aerosol provision system, the method comprising: forming a mouthpiece by positioning a first body of material so that the first body is offset from a second body of material, thereby defining a cavity between the first body and the second body, and disposing a breakable capsule in the cavity; and connecting the mouthpiece to an aerosol generating material, wherein a diameter of the capsule is less than the length of the cavity, and wherein the diameter of the cavity is greater than the length of the cavity.

BRIEF DESCRIPTION OF DRAWINGS

Embodiments of the disclosure will now be described, by way of example only, with reference to the accompanying drawings, in which.

DETAILED DESCRIPTION

Figure 1A:
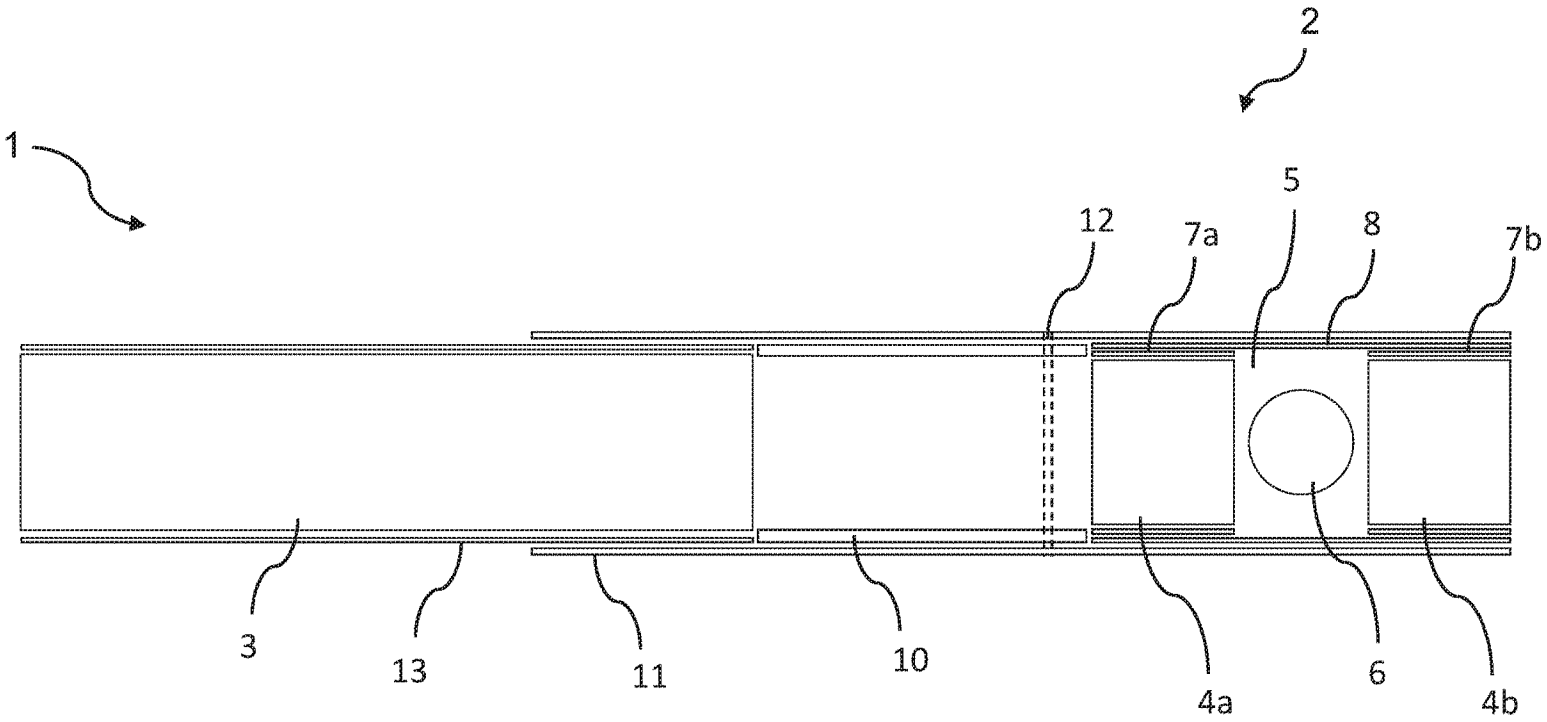
FIG. 1A is a side-on cross sectional view of an article for use with a non-combustible aerosol provision device, the article including a capsule-containing mouthpiece.

As used herein, the term "delivery system" is intended to encompass systems that deliver a substance to a user, and includes: combustible aerosol provision systems, such as cigarettes, cigarillos, cigars, and tobacco for pipes or for roll-your-own or for make-your-own cigarettes (whether based on tobacco, tobacco derivatives, expanded tobacco, reconstituted tobacco, tobacco substitutes or other smokable material); non-combustible aerosol provision systems that release compounds from an aerosolizable material without combusting the aerosolizable material, such as electronic cigarettes, tobacco heating products, and hybrid systems to generate aerosol using a combination of aerosolizable materials; articles comprising aerosolizable material and configured to be used in one of these non-combustible aerosol provision systems; and aerosol-free delivery systems, such as lozenges, gums, gels, patches, articles comprising inhalable powders, and smokeless tobacco products such as snus and snuff, which deliver a material to a user without forming an aerosol, wherein the material may or may not comprise nicotine.

According to the present disclosure, a "combustible" aerosol provision system is one where a constituent aerosolizable material of the aerosol provision system (or component thereof) is combusted or burned in order to facilitate delivery to a user.

According to the present disclosure, a "non-combustible" aerosol provision system is one where a constituent aerosolizable material of the aerosol provision system (or component thereof) is not combusted or burned in order to facilitate delivery to a user.

In embodiments described herein, the delivery system is a non-combustible aerosol provision system, such as a powered non-combustible aerosol provision system.

The non-combustible aerosol provision system described herein can be an electronic cigarette, also known as a vaping device or electronic nicotine delivery system (END), although it is noted that the presence of nicotine in the aerosolizable material is not a requirement.

The non-combustible aerosol provision system described herein can be a tobacco heating system, also known as a heat-not-burn system.

The non-combustible aerosol provision system described herein can be a hybrid system to generate aerosol using a combination of aerosolizable materials, one or a plurality of which may be heated. Each of the aerosolizable materials may be, for example, in the form of a solid, liquid or gel and may or may not contain nicotine. The hybrid system can comprise a liquid or gel aerosolizable material and a solid aerosolizable material. The solid aerosolizable material may comprise, for example, tobacco or a non-tobacco product.

Typically, the non-combustible aerosol provision system may comprise a non-combustible aerosol provision device and an article for use with the non-combustible aerosol provision system. However, it is envisaged that articles which themselves comprise a means for powering an aerosol generating component may themselves form the non-combustible aerosol provision system.

The non-combustible aerosol provision device can comprise a power source and a controller. The power source may be an electric power source or an exothermic power source. The exothermic power source can comprise a carbon substrate which may be energized so as to distribute power in the form of heat to an aerosolizable material or heat transfer material in proximity to the exothermic power source. The power source, such as an exothermic power source, can be provided in the article so as to form the non-combustible aerosol provision.

The article for use with the non-combustible aerosol provision device can comprise an aerosolizable material, an aerosol generating component, an aerosol generating area, a mouthpiece, and/or an area for receiving aerosolizable material.

The aerosol generating component can be a heater capable of interacting with the aerosolizable material so as to release one or more volatiles from the aerosolizable material to form an aerosol. The aerosol generating component can be capable of generating an aerosol from the aerosolizable material without heating. For example, the aerosol generating component may be capable of generating an aerosol from the aerosolizable material without applying heat thereto, for example via one or more of vibrational, mechanical, pressurization or electrostatic means.

The aerosolizable material may comprise an active material, an aerosol forming material and optionally one or more functional materials. The active material may comprise nicotine (optionally contained in tobacco or a tobacco derivative) or one or more other non-olfactory physiologically active materials. A non-olfactory physiologically active material is a material which is included in the aerosolizable material in order to achieve a physiological response other than olfactory perception.

The aerosol forming material may comprise one or more of glycerine, glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate.

The one or more functional materials may comprise one or more of flavors, carriers, pH regulators, stabilizers, and/or antioxidants.

The article for use with the non-combustible aerosol provision device may comprise aerosolizable material or an area for receiving aerosolizable material. The article for use with the non-combustible aerosol provision device may comprise a mouthpiece. The area for receiving aerosolizable material may be a storage area for storing aerosolizable material. For example, the storage area may be a reservoir. The area for receiving aerosolizable material may be separate from, or combined with, an aerosol generating area.

Aerosolizable material, which also may be referred to herein as aerosol generating material, is material that is capable of generating aerosol, for example when heated, irradiated or energized in any other way. Aerosolizable material may, for example, be in the form of a solid, liquid or gel which may or may not contain nicotine and/or flavorants. In some embodiments, the aerosolizable material may comprise an "amorphous solid", which may alternatively be referred to as a "monolithic solid" (i.e. non-fibrous) . In some embodiments, the amorphous solid may be a dried gel. The amorphous solid is a solid material that may retain some fluid, such as liquid, within it. In some embodiments, the aerosolizable material may for example comprise from about 50 wt %, 60 wt % or 70 wt % of amorphous solid, to about 90 wt %, 95 wt % or 100 wt % of amorphous solid.

The aerosolizable material may be present on a substrate. The substrate may, for example, be or comprise paper, card, paperboard, cardboard, reconstituted aerosolizable material, a plastics material, a ceramic material, a composite material, a plant based material such as wood or bamboo, glass, a metal, or a metal alloy.

An aerosol modifying agent is a substance that is able to modify aerosol in use. The agent may modify aerosol in such a way as to create a physiological or sensory effect on the human body. Example aerosol modifying agents are flavorants and sensates. A sensate creates an organoleptic sensation that can be perceived through the senses, such as a cool or sour sensation.

A susceptor is material that is heatable by penetration with a varying magnetic field, such as an alternating magnetic field. The heating material may be an electrically-conductive material, so that penetration thereof with a varying magnetic field causes induction heating of the heating material. The heating material may be magnetic material, so that penetration thereof with a varying magnetic field causes magnetic hysteresis heating of the heating material. The heating material may be both electrically-conductive and magnetic, so that the heating material is heatable by both heating mechanisms.

Induction heating is a process in which an electrically-conductive object is heated by penetrating the object with a varying magnetic field. The process is described by Faraday's law of induction and Ohm's law. An induction heater may comprise an electromagnet and a device for passing a varying electrical current, such as an alternating current, through the electromagnet. When the electromagnet and the object to be heated are suitably relatively positioned so that the resultant varying magnetic field produced by the electromagnet penetrates the object, one or more eddy currents are generated inside the object. The object has a resistance to the flow of electrical currents. Therefore, when such eddy currents are generated in the object, their flow against the electrical resistance of the object causes the object to be heated. This process is called Joule, ohmic, or resistive heating. An object that is capable of being inductively heated is known as a susceptor.

The susceptor can be in the form of a closed circuit. It has been found that, when the susceptor is in the form of a closed circuit, magnetic coupling between the susceptor and the electromagnet in use is enhanced, which results in greater or improved Joule heating.

Magnetic hysteresis heating is a process in which an object made of a magnetic material is heated by penetrating the object with a varying magnetic field. A magnetic material can be considered to comprise many atomic-scale magnets, or magnetic dipoles. When a magnetic field penetrates such material, the magnetic dipoles align with the magnetic field. Therefore, when a varying magnetic field, such as an alternating magnetic field, for example as produced by an electromagnet, penetrates the magnetic material, the orientation of the magnetic dipoles changes with the varying applied magnetic field. Such magnetic dipole reorientation causes heat to be generated in the magnetic material.

When an object is both electrically-conductive and magnetic, penetrating the object with a varying magnetic field can cause both Joule heating and magnetic hysteresis heating in the object. Moreover, the use of magnetic material can strengthen the magnetic field, which can intensify the Joule heating.

In each of the above processes, as heat is generated inside the object itself, rather than by an external heat source by heat conduction, a rapid temperature rise in the object and more uniform heat distribution can be achieved, particularly through selection of suitable object material and geometry, and suitable varying magnetic field magnitude and orientation relative to the object. Moreover, as induction heating and magnetic hysteresis heating do not require a physical connection to be provided between the source of the varying magnetic field and the object, design freedom and control over the heating profile may be greater, and cost may be lower.

Articles, for instance those in the shape of rods, are often named according to the product length: "regular" (typically in the range 68-75 mm, e.g. from about 68 mm to about 72 mm), "short" or "mini" (68 mm or less), "king-size" (typically in the range 75-91 mm, e.g. from about 79 mm to about 88 mm), "long" or "super-king" (typically in the range 91-105 mm, e.g. from about 94 mm to about 101 mm) and "ultra-long" (typically in the range from about 110 mm to about 121 mm).

They are also named according to the product circumference: "regular" (about 23-25 mm), "wide" (greater than 25 mm), "slim" (about 22-23 mm), "demi-slim" (about 19-22 mm), "super-slim" (about 16-19 mm), and "micro-slim" (less than about 16 mm).

Accordingly, an article in a king-size, super-slim format will, for example, have a length of about 83 mm and a circumference of about 17 mm.

Each format may be produced with mouthpieces of different lengths. The mouthpiece length will be from about 10 mm to 50 mm. A tipping paper connects the mouthpiece to the aerosol generating material and will usually have a greater length than the mouthpiece, for example from 3 to 10 mm longer, such that the tipping paper covers the mouthpiece and overlaps the aerosol generating material, for instance in the form of a rod of substrate material, to connect the mouthpiece to the rod.

The tipping paper or any of the papers/wrappers described herein can comprise a sensate material. The sensate material may comprise a flavorant, as herein described. In some embodiments, the flavorant may suitably be licorice (liquorice), rose oil, vanilla, lemon oil, orange oil, a mint-flavor, suitably menthol and/or a mint oil from any species of the genus Mentha such as peppermint oil and/or spearmint oil, or lavender, fennel or anise. The sensate material can comprise sugars and/or sugar substitutes (e.g., sucralose, acesulfame potassium, aspartame, saccharine, cyclamates, lactose, sucrose, glucose, fructose, sorbitol, or mannitol). Additionally or alternatively, the sensate material may comprise a material that delivers a cooling, heating or sour sensation to the consumer during use of the article.

In some embodiments, the sensate material may comprise one or more of pH regulators, stabilizers, and/or antioxidants. These materials may help to increase the shelf-life of the wrapper and thus the article.

The sensate material can be encapsulated in an encapsulating material. For instance, the sensate material can be provided in the form of microcapsules which are applied to the tipping paper or other wrapper. Encapsulation of the sensate material may provide various advantages. For example, as discussed below, the sensate material may comprise or consist of a flavorant having a desired taste or aroma. Encapsulation may enhance the longevity of the taste and/or aroma.

In particular, encapsulation of the sensate material may improve the longevity of the aroma of the sensate material by reinforcing the flavor detected by the user. Thus, the aroma may continue to be detected by a user even after the flavor has diminished (e.g. when the flavor is no longer detectable by the user or is less detectable by the consumer), thereby enhancing the user's experience.

The encapsulated sensate material may also help to mask other aromas that may be emitted by components of the article for use in a non-combustible aerosol provision system before or during its use.

The encapsulated sensate material may exhibit an aroma that is indicative of the flavor of the sensate material. For example, the aroma may provide the user with a cue to the flavor of the sensate material. This may help the user to place the flavor of the sensate material rapidly.

Articles and their aerosol generating materials and mouthpieces described herein can be made in, but are not limited to, any of the above formats.

The terms 'upstream' and 'downstream' used herein are relative terms defined in relation to the direction of mainstream aerosol drawn though an article or device in use. Although a component or part of an article is referred to as a 'mouthpiece' herein, this component or part of the article can alternatively be a portion or component which is downstream of an aerosol generating material, without necessarily being arranged to be at least partially placed in a user's mouth.

The filamentary tow material described herein can comprise cellulose acetate fiber tow. The filamentary tow can also be formed using other materials used to form fibers, such as polyvinyl alcohol (PVOH), polylactic acid (PLA), polycaprolactone (PCL), poly(1-4 butanediol succinate) (PBS), poly(butylene adipate-co-terephthalate)(PBAT), starch based materials, cotton, aliphatic polyester materials and polysaccharide polymers or a combination thereof. The filamentary tow may be plasticized with a suitable plasticizer for the tow, such as triacetin where the material is cellulose acetate tow, or the tow may be non-plasticized.

The tow can have any suitable specification, such as fibers having a 'Y' shaped or other cross section such as 'X' shaped, filamentary denier values between 2.5 and 15 denier per filament, for example between 8.0 and 11.0 denier per filament and total denier values of 5,000 to 50,000, for example between 10,000 and 40,000.

As used herein, the term "tobacco material" refers to any material comprising tobacco or derivatives or substitutes thereof. The term "tobacco material" may include one or more of tobacco, tobacco derivatives, expanded tobacco, reconstituted tobacco or tobacco substitutes. The tobacco material may comprise one or more of ground tobacco, tobacco fiber, cut tobacco, extruded tobacco, tobacco stem, tobacco lamina, reconstituted tobacco and/or tobacco extract.

As used herein, the terms "flavor" and "flavorant" refer to materials which, where local regulations permit, may be used to create a desired taste or aroma in a product for adult consumers. One or more flavors can be used as the aerosol modifying agent described herein. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

In the figures described herein, like reference numerals are used to illustrate equivalent features, articles or components.

Figure 1B:
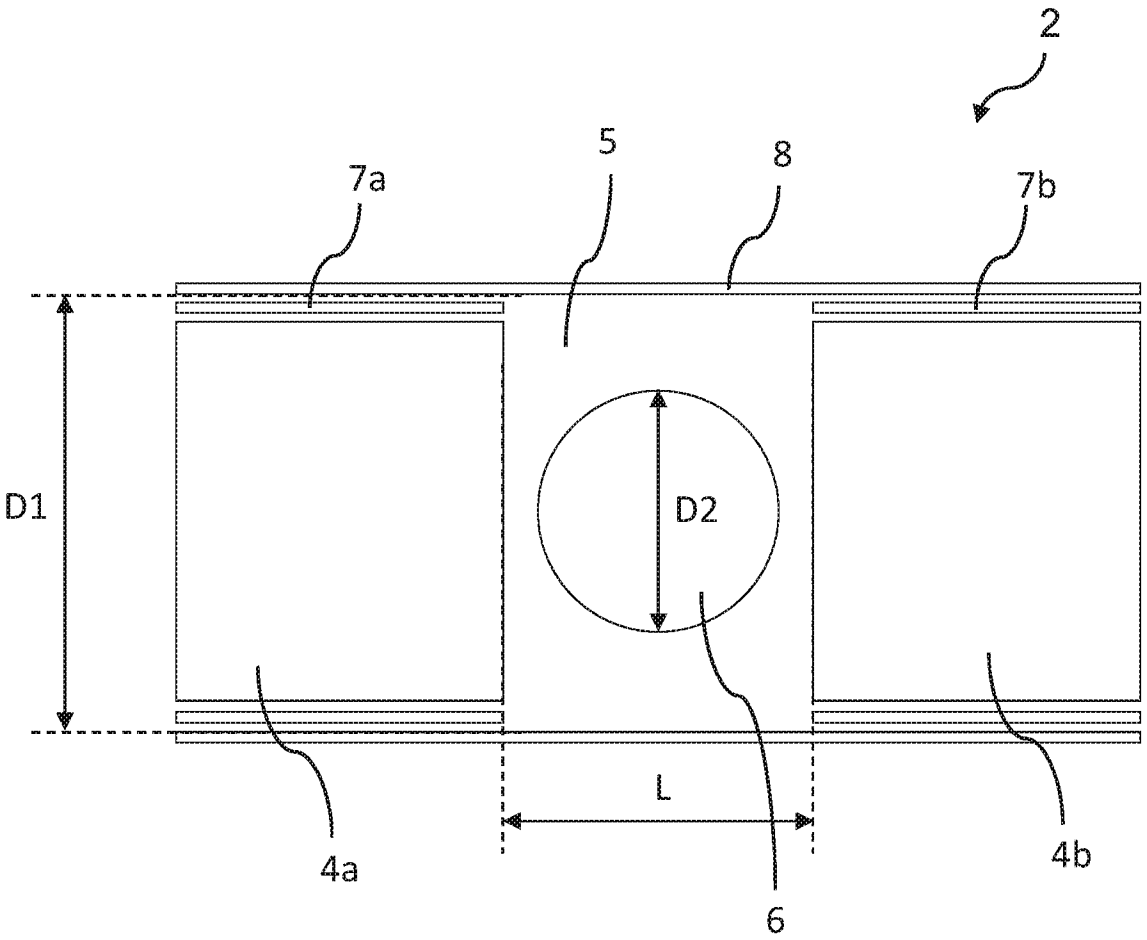
FIG. 1B is a side-on cross sectional view of the capsule-containing portion of the mouthpiece shown in FIG. 1A.

FIG. 1A is a side-on cross sectional view of an article 1 for use with a non-combustible aerosol provision device. FIG. 1B is side-on cross sectional view of the capsule-containing portion of the mouthpiece shown in FIG. 1A.

The article 1 comprises a mouthpiece 2, and a cylindrical rod of aerosol generating material 3, in the present case tobacco material, connected to the mouthpiece 2. The mouthpiece 2 and the rod of aerosol generating material 3 are aligned along a common longitudinal axis of the article 1 (not shown). Herein, the terms 'longitudinal' and 'longitudinally' refers to a direction along the longitudinal axis of the article 1, while the terms 'transverse' and 'transversely' refer to a direction substantially perpendicular to the longitudinal axis of the article 1.

The mouthpiece 2 comprises a first body of material 4*a* and a second body of material 4*b*. The second body 4*b* is downstream from the first body 4*a*, and is offset from the first body 4*a* with respect to the longitudinal axis of the article 1, so as to define a cavity 5 between the first body 4*a* and the second body 4*b*. A breakable capsule 6 is disposed in the cavity 5. In use, the user breaks the capsule 6 to release the contents of the capsule, such as a flavorant. This will be described in more detail below.

As illustrated in FIG. 1B, the diameter D2 of the capsule 6 is less than the length L of the cavity 5, and the diameter D1 of the cavity 5 is greater than the length L of the cavity 5. This arrangement provides the advantage that the transverse range of movement of the capsule 6 is greater than its longitudinal range of movement. When the user shakes the article 1, the movement of the capsule 6 within the cavity 5 is mainly in a transverse direction. This allows the user to be provided with a tactile and an aural indication of the existence of the capsule 6 within the article 1. The limited longitudinal range of movement of the capsule 6 compared to its transverse movement aids the consumer in accurately locating the capsule 6 longitudinally and therefore in breaking the capsule 6. A visual indication may be provided on an external surface of the mouthpiece indicating the location of the capsule to the consumer.

In the present example, the cavity 5 has a diameter D1 of about 5 mm and a length L of 4 mm. The capsule 6 is substantially spherical in shape, and has a diameter D2 of 3 mm.

In some examples, the diameter of the capsule may be in the range 2 mm to 6 mm. In particular, the diameter of the capsule may be one of about 2 mm, about 3 mm, about 4 mm, about 5 mm or about 6 mm.

In some examples, the diameter of the cavity may be in the range 3.5 mm to 8 mm. In particular, the diameter of the cavity may be one of about 3.5 mm, about 4 mm, about 4.5 mm, about 5 mm, about 5.5 mm, about 6 mm, about 6.5 mm, about 7 mm, about 7.5 mm or about 8 mm.

In some examples, the length of the cavity may be in the range about 2 mm to about 6 mm. In particular, the length of the cavity may be one of about 2 mm, about 3 mm, about 4 mm, about 5 mm or about 6 mm.

The diameter of the cavity can, for instance, be between about 3.5 mm and 6 mm, with the capsule diameter between about 3 mm and 4.5 mm and the cavity length between about 4 mm and about 6 mm. The diameter of the cavity can, for instance, be between about 4.5 mm and 7 mm, with the capsule diameter between about 3 mm and 4 mm and the cavity length between about 4 mm and about 6 mm. The diameter of the cavity can, for instance, be about 5 mm, with the capsule diameter of about 3 mm and the cavity length about 4 mm. Alternatively, the diameter of the cavity can be about 7 mm, with the capsule diameter being about 3.5 mm and the length of the cavity being about 5 mm.

In some examples, the volume of the cavity may be in the range about 25 $mm^3$ to about 300 $mm^3$. In particular, the volume of the cavity may be one of about 25 $mm^3$, about 50 $mm^3$, about 75 $mm^3$, about 100 $mm^3$, about 150 $mm^3$, about 200 $mm^3$, about 250 $mm^3$ or about 300 $mm^3$.

A first plug wrap 7*a* surrounds the first body of material 4*a*, and a second plug wrap 7*b* surrounds the second body of material 4*b*. A paper wrapper 8 overlies the first and second plug wraps 7*a*, 7*b*, and connects the first and second bodies of material 4*a*, 4*b*. The paper wrapper 8 defines a wall of the cavity 5. The diameter D1 of the cavity 5 is measured between two diametrically opposite points on the internal surface of the paper wrapper 8.

In some embodiments, the first and second plug wraps 7*a*, 7*b* have a basis weight of less than 50 $g/m^2$, such as between about 20 $g/m^2$ and 40 $g/m^2$.

In some embodiments, the first and second plug wraps 7*a*, 7*b* have a thickness of between 30 μm and 60 μm, such as between 35 μm and 45 μm.

In some embodiments, the first and second plug wraps 7*a*, 7*b* are non-porous plug wraps, for instance having a permeability of less than 100 Coresta units, for instance less than 50 Coresta units. However, in other embodiments, the first and second plug wraps 7*a*, 7*b* can be porous plug wraps, for instance having a permeability of greater than 200 Coresta Units.

In the present example, the paper wrapper 8 has a basis weight of 27 $g/m^2$. The paper wrapper 8 may have a basis weight of less than 50 $g/m^2$, more preferably between about 20 $g/m^2$ and 40 $g/m^2$.

In the present example, the paper wrapper 8 has a thickness of 45 μm. The paper wrapper 8 may have a thickness of between 30 μm and 60 μm, such as between 40 μm and 50 μm.

In some embodiments, the paper wrapper 8 is a non-porous paper, for instance having a permeability of less than 100 Coresta units, for instance less than 50 Coresta units.

However, in other examples, the paper wrapper can be a porous paper, for instance having a permeability of greater than 200 Coresta Units.

The bodies of material 4*a*, 4*b* are in the form of cylinders, and are aligned along the longitudinal axis of the article 1. In the present example, the first and second bodies 4*a*, 4*b* both have a length of 6 mm. In other examples, the first and second bodies may have different lengths. In some embodiments, each of the lengths of the first and second bodies of material 4*a*, 4*b* is less than about 8 mm. For example, each of the lengths of the first and second bodies of material 4*a*, 4*b* is less than about 7 mm. In addition, or as an alternative, each of the lengths of the first and second bodies of material 4*a*, 4*b* is at least about 4 mm. In some embodiments, each of the lengths of the first and second bodies of material 4*a*, 4*b* is at least about 5 mm. In some embodiments, each of the lengths of the bodies of material 4*a*, 4*b* is from about 4 mm to about 8 mm, such as from about 5 mm to about 7 mm. The second body of material 4*b* can, for instance, have a length of from about 6 mm to about 8 mm and the first body of material 4*a* can have a length of from about 5 mm to about 8 mm.

In the present example, the first and second bodies of material 4*a*, 4*b* are formed from filamentary tow. In the present example, the tow used in the bodies of material 4*a*, 4*b* has a denier per filament (d.p.f.) of 8.4 and a total denier of 21,000. Alternatively, the tow can, for instance, have a denier per filament (d.p.f.) of 9.5 and a total denier of 12,000. In the present example, the tow comprises plasticized cellulose acetate tow. The plasticizer used in the tow comprises about 8% by weight of the tow, but can alternatively comprise an amount between about 5% and about 12%. In the present example, the plasticizer is triacetin.

In other examples, different materials can be used to form the bodies of material 4*a*, 4*b*. For instance, rather than tow, the bodies 4*a*, 4*b* can be formed from paper, for instance in a similar way to paper filters known for use in cigarettes. For instance, the paper, or other cellulose-based material, can be provided as one or more portions of sheet material which is folded and/or crimped to form either or each of the bodies 4*a*, 4*b*. The sheet material can have a basis weight of from 15 gsm to 60 gsm, for instance between 20 and 50 gsm. The sheet material can, for instance, have a basis weight in any of the ranges between 15 and 25 gsm, between 25 and 30 gsm, between 30 and 40 gsm, between 40 and 45 gsm and between 45 and 50 gsm. Additionally or alternatively, the sheet material can have a width of between 50 mm and 200 mm, for instance between 60 mm and 150 mm, or between 80 mm and 150 mm. For instance, the sheet material can have a basis weight of between 20 and 50 gsm and a width between 80 mm and 150 mm. This can, for instance, enable the cellulose-based bodies to have appropriate pressure drops for an article having dimensions as described herein. The pressure drop across each of the bodies 4*a*, 4*b*, can, for instance, be between 0.3 and 5 mmWG per mm of length of the bodies 4*a*, 4*b*, for instance between 0.5 mmWG and 2 mmWG per mm of length of the bodies 4*a*, 4*b*. The pressure drop can, for instance, be between 0.5 and 1 mmWG/mm of length, between 1 and 1.5 mmWG/mm of length or between 1.5 and 2 mmWG/mm of length. The total pressure drop across each of the bodies 4*a*, 4*b* can, for instance, be between 3 mmWG and 8 mWG, or between 4 mmWG and 7 mmWG. The total pressure drop across each body 4*a*, 4*b* can be about 5, 6 or 7 mmWG. The crimping factor of the sheet material can be adjusted to also influence the pressure drop across either or both of the bodies 4*a*, 4*b*.

Alternatively, the bodies 4*a*, 4*b* can be formed from tows other than cellulose acetate, for instance polylactic acid (PLA), other materials described herein for filamentary tow or similar materials. The tow, whether formed from cellulose acetate or other materials, can have a d.p.f. of at least 5, such as at least 6, and for example at least 7. These values of denier per filament provide a tow which has relatively coarse, thick fibers with a lower surface area which result in a lower pressure drop across the mouthpiece 2 than tows having lower d.p.f. values. In some embodiments, to achieve a sufficiently uniform body of material, the tow has a denier per filament of no more than 12 d.p.f, such as no more than 11 d.p.f. and for example no more than 10 d.p.f.

The total denier of the tow forming the bodies of material 4*a*, 4*b* can be at most 30,000, such as at most 28,000 and for example at most 25,000. These values of total denier provide a tow which takes up a reduced proportion of the cross sectional area of the mouthpiece 2 which results in a lower pressure drop across the mouthpiece 2 than tows having higher total denier values. For appropriate firmness of the bodies of material 4*a*, 4*b*, the tow can have a total denier of at least 8,000 and such as at least 10,000. In some embodiments, the denier per filament is between 5 and 12 while the total denier is between 10,000 and 25,000. In still other embodiments, the denier per filament is between 6 and 10 while the total denier is between 11,000 and 22,000. In some embodiments the cross-sectional shape of the filaments of tow are 'Y' shaped, although in other embodiments other shapes such as 'X' shaped filaments can be used, with the same d.p.f. and total denier values as provided herein.

Irrespective of the material used to form the bodies 4*a*, 4*b*, the pressure drop across each of the bodies 4*a*, 4*b*, can, for instance, be between 0.3 and 5 mmWG per mm of length of the bodies 4*a*, 4*b*, for instance between 0.5 mmWG and 2 mmWG per mm of length of the bodies 4*a*, 4*b*. The pressure drop can, for instance, be between 0.5 and 1 mmWG/mm of length, between 1 and 1.5 mmWG/mm of length or between 1.5 and 2 mmWG/mm of length.

The total pressure drop across each of the bodies 4*a*, 4*b* can, for instance, be between 3 mmWG and 8 mWG, or between 4 mmWG and 7 mmWG. The total pressure drop across each body 4*a*, 4*b* can be about 5, 6 or 7 mmWG.

The capsule 6 has a solid, frangible shell surrounding a liquid payload. In the present example, a single capsule 6 is used. In other examples, a plurality of breakable capsules may be disposed within the cavity 5, for instance 2, 3 or more breakable capsules. The length and/or diameter of the cavity 5 can be increased to accommodate the number of capsules required, for instance while the diameter of the cavity 5 is greater than the length of the cavity 5. In examples where a plurality of capsules is used, the individual capsules may be the same as each other, or may differ from one another in terms of size and/or capsule payload.

The capsule 6 has a core-shell structure. In other words, the capsule 6 comprises a shell encapsulating a liquid aerosol modifying agent, for instance a flavorant or other agent, which can be any one of the flavorants or aerosol modifying agents described herein. The shell of the capsule can be ruptured by a user to release the flavorant or other agent into the body of material 6. One or both of the first and second plug wraps 7*a*, 7*b* can comprise a barrier coating to make the material of the plug wrap substantially impermeable to the liquid payload of the capsule 6. Alternatively or in addition, the paper wrapper 8 can comprise a barrier coating to make the material of the paper wrapper 8 substantially impermeable to the liquid payload of the capsule 6.

The shell of the capsule 6 comprises an encapsulating material or a barrier material which creates a shell around a core that comprises the aerosol modifying agent. The shell structure hinders migration of the aerosol modifying agent during storage of the article 1 but allows controlled release of the aerosol modifying agent, also referred to as an aerosol modifier, during use.

The barrier material (also referred to herein as the encapsulating material) is frangible. The capsule is crushed or otherwise fractured or broken by the user to release the encapsulated aerosol modifier. Typically, the capsule is broken immediately prior to heating being initiated but the user can select when to release the aerosol modifier. The term "breakable capsule" refers to a capsule, wherein the shell can be broken by means of a pressure to release the core; more specifically the shell can be ruptured under the pressure imposed by the user's fingers when the user wants to release the core of the capsule.

In some cases, the barrier material is heat resistant. That is to say, in some cases, the barrier will not rupture, melt or otherwise fail at the temperature reached at the capsule site during operation of the aerosol provision device. Illustratively, a capsule located in a mouthpiece may be exposed to temperatures in the range of 30° C. to 100° C. for example, and the barrier material may continue to retain the liquid core up to at least about 50° C. to 120° C.

In other cases, the capsule releases the core composition on heating, for example by melting of the barrier material or by capsule swelling leading to rupture of the barrier material.

The total weight of the capsule may be in the range of about 1 mg to about 100 mg, suitably about 5 mg to about 60 mg, about 8 mg to about 50 mg, about 10 mg to about 20 mg, or about 12 mg to about 18 mg.

The total weight of the core formulation may be in the range of about 2 mg to about 90 mg, suitably about 3 mg to about 70 mg, about 5 mg to about 25 mg, about 8 mg to about 20 mg, or about 10 mg to about 15 mg.

The capsule may present a crush strength from about 4.5 N to about 40 N, more preferably from about 5 N to about 30 N or to about 28 N (for instance about 9.8 N to about 24.5 N). The capsule burst strength can be measured using a force gauge to measure the force at which the capsule bursts, as described in more detail later in this document.

The capsules may be substantially spherical and have a diameter of at least about 0.4 mm, 0.6 mm, 0.8 mm, 1.0 mm, 2.0 mm, 2.5 mm, 2.8 mm or 3.0 mm. The diameter of the capsules may be less than about 10.0 mm, 8.0 mm, 7.0 mm, 6.0 mm, 5.5 mm, 5.0 mm, 4.5 mm, 4.0 mm, 3.5 mm or 3.2 mm. Illustratively, the capsule diameter may be in the range of about 0.4 mm to about 10.0 mm, about 0.8 mm to about 6.0 mm, about 2.5 mm to about 5.5 mm or about 2.8 mm to about 3.2 mm. In some cases, the capsule may have a diameter of about 3.0 mm. These sizes are particularly suitable for incorporation of the capsule into an article as described herein.

In some embodiments the pressure drop or difference (also referred to a resistance to draw) across the article, measured as the open pressure drop (i.e. with the ventilation openings open), reduces by less than 8 $mmH_2O$ when the capsule is broken. In another embodiment, the open pressure drop reduces by less than 6 $mmH_2O$, such as less than 5 $mmH_2O$. These values are measured as the average achieved by at least 80 articles made to the same design. Such small changes in pressure drop mean that other aspects of the product design, such as setting the correct ventilation level for a given product pressure drop, can be achieved irrespective of whether or not the consumer chooses to break the capsule.

The barrier material may comprise one or more of a gelling agent, a bulking agent, a buffer, a coloring agent and a plasticizer. Suitably, the gelling agent may be, for example, a polysaccharide or cellulosic gelling agent, a gelatin, a gum, a gel, a wax or a mixture thereof. Suitable polysaccharides include alginates, dextrans, maltodextrins, cyclodextrins and pectins. Suitable alginates include, for instance, a salt of alginic acid, an esterified alginate or glyceryl alginate. Salts of alginic acid include ammonium alginate, triethanolamine alginate, and group I or II metal ion alginates like sodium, potassium, calcium and magnesium alginate. Esterified alginates include propylene glycol alginate and glyceryl alginate. In an embodiment, the barrier material is sodium alginate and/or calcium alginate. Suitable cellulosic materials include methyl cellulose, ethyl cellulose, hydroxyethyl cellulose, hydroxypropyl cellulose, carboxymethyl cellulose, cellulose acetate and cellulose ethers. The gelling agent may comprise one or more modified starches. The gelling agent may comprise carrageenans. Suitable gums include agar, gellan gum, gum Arabic, pullulan gum, mannan gum, gum ghatti, gum tragacanth, Karaya, locust bean, acacia gum, guar, quince seed and xanthan gums. Suitable gels include agar, agarose, carrageenans, furoidan and furcellaran. Suitable waxes include carnauba wax. In some cases, the gelling agent may comprise carrageenans and/or gellan gum; these gelling agents are particularly suitable for inclusion as the gelling agent as the pressure required to break the resulting capsules is particularly suitable.

The barrier material may comprise one or more bulking agents, such as starches, modified starches (such as oxidized starches) and sugar alcohols such as maltitol.

The barrier material may comprise a coloring agent which renders easier the location of the capsule within the aerosol generating device during the manufacturing process of the aerosol generating device. The coloring agent can be chosen among colorants and pigments.

The barrier material may further comprise at least one buffer, such as a citrate or phosphate compound.

The barrier material may further comprise at least one plasticizer, which may be glycerol, sorbitol, maltitol, triacetin, polyethylene glycol, propylene glycol or another polyalcohol with plasticizing properties, and optionally one acid of the monoacid, diacid or triacid type, especially citric acid, fumaric acid, malic acid, and the like. The amount of plasticizer ranges from 1% to 30% by weight, such as from 2% to 15% by weight, and for example from 3 to 10% by weight of the total dry weight of the shell.

The barrier material may also comprise one or more filler materials. Suitable filler materials include comprising starch derivatives such as dextrin, maltodextrin, cyclodextrin (alpha, beta or gamma), or cellulose derivatives such as hydroxypropyl-methylcellulose (HPMC), hydroxypropylcellulose (HPC), methylcellulose (MC), carboxy-methylcellulose (CMC), polyvinyl alcohol, polyols or mixture thereof. Dextrin is a suitable filler. The amount of filler in the shell is at most 98.5%, such as from 25 to 95%, for example from 40 to 80%, or from 50 to 60% by weight on the total dry weight of the shell.

The capsule shell may additionally comprise a hydrophobic outer layer which reduces the susceptibility of the capsule to moisture-induced degradation. The hydrophobic outer layer is suitably selected from the group comprising waxes, especially carnauba wax, candelilla wax or beeswax, carbowax, shellac (in alcoholic or aqueous solution), ethyl cellulose, hydroxypropyl methyl cellulose, hydroxyl-propylcellulose, latex composition, polyvinyl alcohol, or a combination thereof. In some embodiments, the at least one moisture barrier agent is ethyl cellulose or a mixture of ethyl cellulose and shellac.

The capsule core comprises the aerosol modifier. This aerosol modifier may be any volatile substance which modifies at least one property of the aerosol. For example, the aerosol substance may modify the pH, the sensorial properties, the water content, the delivery characteristics or the flavor. In some cases, the aerosol modifier may be selected from an acid, a base, water or a flavorant. In some embodiments, the aerosol modifier comprises one or more flavorants.

The flavorant may suitably be licorice, rose oil, vanilla, lemon oil, orange oil, a mint-flavor, suitably menthol and/or a mint oil from any species of the genus Mentha such as peppermint oil and/or spearmint oil, or lavender, fennel or anise. In some cases, the flavorant comprises menthol.

In some cases, the capsule may comprise at least about 25% w/w flavorant (based on the total weight of the capsule), suitably at least about 30% w/w flavorant, 35% w/w flavorant, 40% w/w flavorant, 45% w/w flavorant or 50% w/w flavorant.

In some cases, the core may comprise at least about 25% w/w flavorant (based on the total weight of the core), suitably at least about 30% w/w flavorant, 35% w/w flavorant, 40% w/w flavorant, 45% w/w flavorant or 50% w/w flavorant. In some cases, the core may comprise less than or equal to about 75% w/w flavorant (based on the total weight of the core), suitably less than or equal to about 65% w/w flavorant, 55% w/w flavorant, or 50% w/w flavorant. Illustratively, the capsule may include an amount of flavorant in the range of 25-75% w/w (based on the total weight of the core), about 35-60% w/w or about 40-55% w/w.

The capsules may include at least about 2 mg, 3 mg or 4 mg of the aerosol modifier, suitably at least about 4.5 mg of the aerosol modifier, 5 mg of the aerosol modifier, 5.5 of mg the aerosol modifier or 6 mg of the aerosol modifier.

In some cases, the consumable comprises at least about 7 mg of the aerosol modifier, suitably at least about 8 mg of the aerosol modifier, 10 mg of the aerosol modifier, 12 mg of the aerosol modifier or 15 mg of the aerosol modifier. The core may also comprise a solvent which dissolves the aerosol modifier. Any suitable solvent may be used.

Where the aerosol modifier comprises a flavorant, the solvent may suitably comprise short or medium chain fats and oils. For example, the solvent may comprise tri-esters of glycerol such as C2-C12 triglycerides, suitably C6-C10 triglycerides or Cs-C12 triglycerides. For example, the solvent may comprise medium chain triglycerides (MCT-C8-C12), which may be derived from palm oil and/or coconut oil.

The esters may be formed with caprylic acid and/or capric acid. For example, the solvent may comprise medium chain triglycerides which are caprylic triglycerides and/or capric tryglycerides. For example, the solvent may comprise compounds identified in the CAS registry by numbers 73398-61-5, 65381-09-1, 85409-09-2. Such medium chain triglycerides are odorless and tasteless.

The hydrophilic-lipophilic balance (HLB) of the solvent may be in the range of 9 to 13, suitably 10 to 12. Methods of making the capsules include co-extrusion, optionally followed by centrifugation and curing and/or drying. The contents of WO 2007/010407 A2 is incorporated by reference, in its entirety.

The aerosol generating material 3 provides an aerosol when heated, for instance within a non-combustible aerosol provision device as described herein, forming a system. In other embodiments the article 1 can include its own heat source, forming and used in an aerosol provision system without requiring a separate aerosol provision device.

In some embodiments, when the aerosol generating material 3 is heated to provide an aerosol, for instance within a non-combustible aerosol provision device as described herein, the part of the mouthpiece 2 in which the capsule is located reaches a temperature of between 58 and 70 degrees Centigrade during use of the system to generate the aerosol. As a result of this temperature, the capsule contents are warmed sufficiently to promote volatization of the capsule contents, for instance an aerosol modifying agent, into the aerosol formed by the system as the aerosol passes through the mouthpiece 2. Warming the content of the capsule 6 can take place, for instance, before the capsule 6 has been broken, such that when the capsule 6 is broken, its contents are more readily released into the aerosol passing through the mouthpiece 2. Alternatively, the content of the capsule 6 can be warmed to this temperature after the capsule 6 has been broken, again resulting in the increased release of the content into the aerosol. Advantageously, mouthpiece temperatures in the range of 58 to 70 degrees Centigrade have been found to be high enough that the capsule content can be more readily released, but low enough that the outer surface of the portion of the mouthpiece 2 in which the capsule is located does not reach an uncomfortable temperature for the consumer to touch in order to burst the capsule 6 by squeezing on the mouthpiece 2.

The aerosol generating material 3, also referred to herein as an aerosol generating substrate 3, comprises at least one aerosol forming material. In the present example, the aerosol forming material is glycerol. In alternative examples, the aerosol forming material can be another material as described herein or a combination thereof. The aerosol forming material has been found to improve the sensory performance of the article, by helping to transfer compounds such as flavor compounds from the aerosol generating material to the consumer. However, an issue with adding such aerosol forming materials to the aerosol generating material within an article for use in a non-combustible aerosol provision system can be that, when the aerosol forming material is aerosolized upon heating, it can increase the mass of aerosol which is delivered by the article, and this increased mass can maintain a higher temperature as it passes through the mouthpiece. As it passes through the mouthpiece, the aerosol transfers heat into the mouthpiece and this warms the outer surface of the mouthpiece, including the area which comes into contact with the consumers lips during use. The mouthpiece temperature can be significantly higher than consumers may be accustomed to when smoking, for instance, conventional cigarettes, and this can be an undesirable effect caused by the use of such aerosol forming materials.

In the present example, the article 1 has an outer circumference of about 16.81 mm (i.e. the article is in the superslim format). In other examples, the article can be provided in any of the formats described herein, for instance having an outer circumference of between 15 mm and 25 mm. Since the article is to be heated to release an aerosol, improved heating efficiency can be achieved using articles having lower outer circumferences within this range, for instance circumferences of less than 23 mm.

The outer circumference of the mouthpiece 2 is substantially the same as the outer circumference of the rod of aerosol generating material 3, such that there is a smooth transition between these components. In the present example, the outer circumference of the mouthpiece 2 is about 16.81 mm. A tipping paper 11 is wrapped around the full length of the mouthpiece 2 and over part of the rod of aerosol generating material 3 and has an adhesive on its inner surface to connect the mouthpiece 2 and rod 3. In the present example, the tipping paper 11 extends 5 mm over the rod of aerosol generating material 3 but it can alternatively extend between 3 mm and 10 mm over the rod 3, or more preferably between 4 mm and 6 mm, to provide a secure attachment between the mouthpiece 2 and rod 3. The tipping paper 11 can have a basis weight which is higher than the basis weight of plug wraps used in the article 1, for instance a basis weight of 40 $g/m^2$ to 80 $g/m^2$, more preferably between 50 $g/m^2$ and 70 $g/m^2$, and in the present example 58 $g/m^2$. These ranges of basis weights have been found to result in tipping papers having acceptable tensile strength while being flexible enough to wrap around the article 1 and adhere to itself along a longitudinal lap seam on the paper. The outer circumference of the tipping paper 11, once wrapped around the mouthpiece 2, is about 16.81 mm.

The pressure drop or difference (also referred to as resistance to draw) across the mouthpiece, for instance the part of the article 1 downstream of the aerosol generating material 3, can be less than about 40 $mmH_2O$. Such pressure drops have been found to allow sufficient aerosol, including desirable compounds such as flavor compounds, to pass through the mouthpiece 2 to the consumer. In some embodiments, the pressure drop across the mouthpiece 2 is less than about 32 $mmH_2O$. In some embodiments, particularly improved aerosol has been achieved using a mouthpiece 2 having a pressure drop of less than 31 $mmH_2O$, for instance about 29 $mmH_2O$, about 28 $mmH_2O$ or about 27.5 $mmH_2O$. Alternatively or additionally, the mouthpiece pressure drop can be at least 10 $mmH_2O$, such as at least 15 $mmH_2O$ and for example at least 20 $mmH_2O$. In some embodiments, the mouthpiece pressure drop can be between about 15 $mmH_2O$ and 40 $mmH_2O$. These values enable the mouthpiece 2 to slow down the aerosol as it passes through the mouthpiece 2 such that the temperature of the aerosol has time to reduce before reaching the downstream end 2*b* of the mouthpiece 2.

In the present example, the mouthpiece 2 includes a hollow tubular element 10, also referred to as a cooling element, upstream of the first body of material 4*a*. In the present example, the hollow tubular element 10 is upstream of, adjacent to and in an abutting relationship with the first body of material 4*a*. The first body of material 4*a* and hollow tubular element 10 each define a substantially cylindrical overall outer shape and share a common longitudinal axis, i.e. the longitudinal axis of the article 1.

The hollow tubular element 10 is formed from a plurality of layers of paper which are parallel wound, with butted seams, to form the tubular element 10. In the present example, first and second paper layers are provided in a two-ply tube, although in other examples 3, 4 or more paper layers can be used forming 3, 4 or more ply tubes. Other constructions can be used, such as spirally wound layers of paper, cardboard tubes, tubes formed using a papier-mâché type process, molded or extruded plastic tubes or similar. The hollow tubular element 10 can also be formed from a fibrous material as described herein, such as one of the tow materials described herein, for instance cellulose acetate tow. The hollow tubular element 10 can also be formed using a stiff plug wrap and/or tipping paper as the plug wrap 7*a*, 7*b* and/or tipping paper 11 described herein, meaning that a separate tubular element is not required. The stiff plug wrap and/or tipping paper is manufactured to have a rigidity that is sufficient to withstand the axial compressive forces and bending moments that might arise during manufacture and whilst the article 1 is in use. For instance, the stiff plug wrap and/or tipping paper can have a basis weight between 70 $g/m^2$ and 120 $g/m^2$, such as between 80 $g/m^2$ and 110 $g/m^2$. Additionally or alternatively, the stiff plug wrap and/or tipping paper can have a thickness between 80 μm and 200 μm, such as between 100 μm and 160 μm, or from 120 μm to 150 μm. It can be desirable for both the plug wrap 7*a*, 7*b* and tipping paper 11 to have values in these ranges, to achieve an acceptable overall level of rigidity for the hollow tubular element 10.

The hollow tubular element 10 can have a wall thickness of at least about 100 μm and up to about 1.5 mm, such as between 100 μm and 1 mm and for example between 150 μm and 500 μm, or about 300 μm. In the present example, the hollow tubular element 10 has a wall thickness of about 290 μm.

In some embodiments, the length of the hollow tubular element 10 is less than about 50 mm. In other embodiments, the length of the hollow tubular element 10 is less than about 40 mm. In still other embodiments, the length of the hollow tubular element 10 is less than about 30 mm. In addition, or as an alternative, the length of the hollow tubular element 10 can be at least about 10 mm. In some embodiments, the length of the hollow tubular element 10 is at least about 15 mm. In some embodiments, the length of the hollow tubular element 10 is from about 20 mm to about 30 mm, such as from about 22 mm to about 28 mm, for example from about 24 to about 26 mm, or about 25 mm. In the present example, the length of the hollow tubular element 10 is 25 mm.

The hollow tubular element 10 is located around and defines an air gap within the mouthpiece 2 which acts as a cooling segment. The air gap provides a chamber through which heated volatilized components generated by the aerosol generating material 3 flow. The hollow tubular element 10 is hollow to provide a chamber for aerosol accumulation yet rigid enough to withstand axial compressive forces and bending moments that might arise during manufacture and whilst the article 1 is in use. The hollow tubular element 10 provides a physical displacement between the aerosol generating material 3 and the first body of material 4*a*. The physical displacement provided by the hollow tubular element 10 will provide a thermal gradient across the length of the hollow tubular element 10.

The hollow tubular element 10 can be configured to provide a temperature differential of at least 40 degrees Celsius between a heated volatilized component entering a first, upstream end of the hollow tubular element 10 and a heated volatilized component exiting a second, downstream end of the hollow tubular element 10. The hollow tubular element 10 is preferably configured to provide a temperature differential of at least 60 degrees Celsius, such as at least 80 degrees Celsius and for example at least 100 degrees Celsius between a heated volatilized component entering a first, upstream end of the hollow tubular element 10 and a heated volatilized component exiting a second, downstream end of the hollow tubular element 10. This temperature differential across the length of the hollow tubular element 10 protects the temperature sensitive first body of material 4*a* from the high temperatures of the aerosol generating material 3 when it is heated.

In alternative articles, the hollow tubular element 10 can be replaced with an alternative cooling element, for instance an element formed from a body of material which allows aerosol to pass through it longitudinally, and which also performs the function of cooling the aerosol.

A hollow tubular element the same or similar to that described above can also be provided at the mouth or downstream end of the mouthpiece 2, for instance being formed from fibrous filter material such as cellulose acetate tow. The length of such a hollow tubular element can be between 5 mm and 20 mm, for instance between 5 mm and 10 mm, for instance about 6 mm, about 7 mm or about 8 mm.

In some examples, the first body of material 4*a*, the second body of material 4*b* and the hollow tubular element 10 are combined using a plug wrap (not shown) which is wrapped around all three sections. In some embodiments, the plug wrap has a basis weight of less than 50 g/m$^2$, such as between about 20 g/m$^2$ and 45 g/m$^2$. In some embodiments, the plug wrap has a thickness of between 30 μm and 60 μm, such as between 35 μm and 45 μm. The plug wrap can be a non-porous plug wrap having a permeability of less than 100 Coresta Units, for instance less than 50 Coresta Units. However, in alternative embodiments, the plug wrap can be a porous plug wrap, for instance having a permeability of greater than 200 Coresta Units.

In the present example, the aerosol generating material 3 is wrapped in a wrapper 13. The wrapper 13 can, for instance, be a paper or paper-backed foil wrapper. In the present example, the wrapper 13 is substantially impermeable to air. In alternative embodiments, the wrapper 13 can have a permeability of less than 100 Coresta Units, such as less than 60 Coresta Units. It has been found that low permeability wrappers, for instance having a permeability of less than 100 Coresta Units, such as less than 60 Coresta Units, result in an improvement in the aerosol formation in the aerosol generating material 3. Without wishing to be bound by theory, it is hypothesized that this is due to reduced loss of aerosol compounds through the wrapper 13. The permeability of the wrapper 13 can be measured in accordance with ISO 2965:2009 concerning the determination of air permeability for materials used as cigarette papers, filter plug wrap and filter joining paper.

In the present embodiment, the wrapper 13 comprises aluminum foil. Aluminum foil has been found to be particularly effective at enhancing the formation of aerosol within the aerosol generating material 3. In the present example, the aluminum foil has a metal layer having a thickness of about 6 μm. In the present example, the aluminum foil has a paper backing. However, in alternative arrangements, the aluminum foil can be other thicknesses, for instance between 4 μm and 16 μm in thickness. The aluminum foil also need not have a paper backing, but could have a backing formed from other materials, for instance to help provide an appropriate tensile strength to the foil, or it could have no backing material. Metallic layers or foils other than aluminum can also be used. The total thickness of the wrapper can be between 20 μm and 60 μm, such as between 30 μm and 50 μm, which can provide a wrapper having appropriate structural integrity and heat transfer characteristics. The tensile force which can be applied to the wrapper before it breaks can be greater than 3,000 grams force, for instance between 3,000 and 10,000 grams force or between 3,000 and 4,500 grams force.

The article has a ventilation level of about 75% of the aerosol drawn through the article. In alternative embodiments, the article can have a ventilation level of between 50% and 80% of aerosol drawn through the article, for instance between 65% and 75%. Ventilation at these levels helps to slow down the flow of aerosol drawn through the mouthpiece 2 and thereby enable the aerosol to cool sufficiently before it reaches the downstream end of the mouthpiece 2. The ventilation is provided directly into the mouthpiece 2 of the article 1. In the present example, the ventilation is provided into the hollow tubular element 10, which has been found to be particularly beneficial in assisting with the aerosol generation process. The ventilation is provided via first and second parallel rows of perforations 12, in the present case formed as laser perforations, at positions 17.925 mm and 18.625 mm respectively from the downstream, mouth-end of the mouthpiece 2. These perforations pass though the tipping paper 11, and hollow tubular element 10. In alternative embodiments, the ventilation can be provided into the mouthpiece at other locations, for instance into the first body of material 4*a* or second body of material 4*b*.

In the present example, the aerosol forming material added to the aerosol generating substrate 3 comprises 14% by weight of the aerosol generating substrate 3. In some embodiments, the aerosol forming material comprises at least 5% by weight of the aerosol generating substrate, such as at least 10%. In some embodiments, the aerosol forming material comprises less than 25% by weight of the aerosol generating substrate, such as less than 20%, for instance between 10% and 20%, between 12% and 18% or between 13% and 16%.

In some embodiments the aerosol generating material 3 is provided as a cylindrical rod of aerosol generating material. Irrespective of the form of the aerosol generating material, it can have a length of about 10 mm to 100 mm. In some embodiments, the length of the aerosol generating material is in the range about 25 mm to 50 mm, such as in the range about 30 mm to 45 mm, and for example about 30 mm to 40 mm.

The volume of aerosol generating material 3 provided can vary from about 200 mm$^3$ to about 4300 mm$^3$, such as from about 500 mm$^3$ to 1500 mm$^3$, for example from about 1000 mm$^3$ to about 1300 mm$^3$. The provision of these volumes of aerosol generating material, for instance from about 1000 mm$^3$ to about 1300 mm$^3$, has been advantageously shown to achieve a superior aerosol, having a greater visibility and sensory performance compared to that achieved with volumes selected from the lower end of the range.

The mass of aerosol generating material 3 provided can be greater than 200 mg, for instance from about 200 mg to 400 mg, such as from about 230 mg to 360 mg, for example from about 250 mg to 360 mg. It has been advantageously found that providing a higher mass of aerosol generating material results in improved sensory performance compared to aerosol generated from a lower mass of tobacco material.

In some embodiments the aerosol generating material or substrate is formed from tobacco material as described herein, which includes a tobacco component.

In the tobacco material described herein, the tobacco component can contain paper reconstituted tobacco. The tobacco component may also contain leaf tobacco, extruded tobacco, and/or bandcast tobacco.

The aerosol generating material 3 can comprise reconstituted tobacco material having a density of less than about 700 milligrams per cubic centimeter (mg/cc). Such tobacco material has been found to be particularly effective at providing an aerosol generating material which can be heated quickly to release an aerosol, as compared to denser materials. For instance, the inventors tested the properties of various aerosol generating materials, such as bandcast reconstituted tobacco material and paper reconstituted tobacco material, when heated. It was found that, for each given aerosol generating material, there is a particular zero heat flow temperature below which net heat flow is endothermic, in other words more heat enters the material than leaves the material, and above which net heat flow is exothermic, in other words more heat leaves the material than enters the material, while heat is applied to the material. Materials having a density less than 700 mg/cc had a lower zero heat flow temperature. Since a significant portion of the heat flow out of the material is via the formation of aerosol, having a lower zero heat flow temperature has a beneficial effect on the time it takes to first release aerosol from the aerosol generating material. For instance, aerosol generating materials having a density of less than 700 mg/cc were found to have a zero heat flow temperature of less than 164° C., as compared to materials with a density over 700 mg/cc, which had zero heat flow temperatures greater than 164° C.

The density of the aerosol generating material also has an impact on the speed at which heat conducts through the material, with lower densities, for instance those below 700 mg/cc, conducting heat more slowly through the material, and therefore enabling a more sustained release of aerosol.

In some embodiments, the aerosol generating material 3 comprises reconstituted tobacco material having a density of less than about 700 mg/cc, for instance paper reconstituted tobacco material. In other embodiments, the aerosol generating material 3 comprises reconstituted tobacco material having a density of less than about 600 mg/cc. Alternatively or in addition, the aerosol generating material 3 can comprise reconstituted tobacco material having a density of at least 350 mg/cc, which is considered to allow for a sufficient amount of heat conduction through the material.

The tobacco material may be provided in the form of cut rag tobacco. The cut rag tobacco can have a cut width of at least 15 cuts per inch (about 5.9 cuts per cm, equivalent to a cut width of about 1.7 mm). In some embodiments, the cut rag tobacco has a cut width of at least 18 cuts per inch (about 7.1 cuts per cm, equivalent to a cut width of about 1.4 mm), such as at least 20 cuts per inch (about 7.9 cuts per cm, equivalent to a cut width of about 1.27 mm). In one example, the cut rag tobacco has a cut width of 22 cuts per inch (about 8.7 cuts per cm, equivalent to a cut width of about 1.15 mm). In some embodiments, the cut rag tobacco has a cut width at or below 40 cuts per inch (about 15.7 cuts per cm, equivalent to a cut width of about 0.64 mm). Cut widths between 0.5 mm and 2.0 mm, for instance between 0.6 mm and 1.5 mm, or between 0.6 mm and 1.7 mm, have been found to result in tobacco material which is preferable in terms of surface area to volume ratio, particularly when heated, and the overall density and pressure drop of the substrate 3. The cut rag tobacco can be formed from a mixture of forms of tobacco material, for instance a mixture of one or more of paper reconstituted tobacco, leaf tobacco, extruded tobacco and bandcast tobacco. In some embodiments the tobacco material comprises paper reconstituted tobacco or a mixture of paper reconstituted tobacco and leaf tobacco.

In the tobacco material described herein, the tobacco material may contain a filler component. The filler component is generally a non-tobacco component, that is, a component that does not include ingredients originating from tobacco. The filler component may be a non-tobacco fiber such as wood fiber or pulp or wheat fiber. The filler component may also be an inorganic material such as chalk, perlite, vermiculite, diatomaceous earth, colloidal silica, magnesium oxide, magnesium sulphate, magnesium carbonate. The filler component may also be a non-tobacco cast material or a non-tobacco extruded material. The filler component may be present in an amount of 0 to 20% by weight of the tobacco material, or in an amount of from 1 to 10% by weight of the composition. In some embodiments, the filler component is absent.

In the tobacco material described herein, the tobacco material contains an aerosol forming material. In this context, an "aerosol forming material" is an agent that promotes the generation of an aerosol. An aerosol forming material may promote the generation of an aerosol by promoting an initial vaporization and/or the condensation of a gas to an inhalable solid and/or liquid aerosol. In some embodiments, an aerosol forming material may improve the delivery of flavor from the aerosol generating material. In general, any suitable aerosol forming material or agents may be included in the aerosol generating material of the invention, including those described herein. Other suitable aerosol forming materials include, but are not limited to: a polyol such as sorbitol, glycerol, and glycols like propylene glycol or triethylene glycol; a non-polyol such as monohydric alcohols, high boiling point hydrocarbons, acids such as lactic acid, glycerol derivatives, esters such as diacetin, triacetin, triethylene glycol diacetate, triethyl citrate or myristates including ethyl myristate and isopropyl myristate and aliphatic carboxylic acid esters such as methyl stearate, dimethyl dodecanedioate and dimethyl tetradecanedioate. In some embodiments, the aerosol forming material may be glycerol, propylene glycol, or a mixture of glycerol and propylene glycol. Glycerol may be present in an amount of from 10 to 20% by weight of the tobacco material, for example 13 to 16% by weight of the composition, or about 14% or 15% by weight of the composition. Propylene glycol, if present, may be present in an amount of from 0.1 to 0.3% by weight of the composition.

The aerosol forming material may be included in any component, for example any tobacco component, of the tobacco material, and/or in the filler component, if present. Alternatively or additionally the aerosol forming material may be added to the tobacco material separately. In either case, the total amount of the aerosol forming material in the tobacco material can be as defined herein.

The tobacco material can contain between 10% and 90% by weight tobacco leaf, wherein the aerosol forming material is provided in an amount of up to about 10% by weight of the leaf tobacco. To achieve an overall level of aerosol forming material between 10% and 20% by weight of the tobacco material, it has been advantageously found that this can be added in higher weight percentages to another component of the tobacco material, such as reconstituted tobacco material.

The tobacco material described herein contains nicotine. The nicotine content is from 0.5 to 1.75% by weight of the tobacco material, and may be, for example, from 0.8 to 1.5% by weight of the tobacco material. Additionally or alternatively, the tobacco material contains between 10% and 90% by weight tobacco leaf having a nicotine content of greater than 1.5% by weight of the tobacco leaf. It has been advantageously found that using a tobacco leaf with nicotine content higher than 1.5% in combination with a lower nicotine base material, such as paper reconstituted tobacco, provides a tobacco material with an appropriate nicotine level but better sensory performance than the use of paper reconstituted tobacco alone. The tobacco leaf, for instance cut rag tobacco, can, for instance, have a nicotine content of between 1.5% and 5% by weight of the tobacco leaf.

The tobacco material described herein can contain an aerosol modifying agent, such as any of the flavors described herein. In one embodiment, the tobacco material contains menthol, forming a mentholated article. The tobacco material can comprise from 3 mg to 20 mg of menthol, such as between 5 mg and 18 mg and for example between 8 mg and 16 mg of menthol. In the present example, the tobacco material comprises 16 mg of menthol. The tobacco material can contain between 2% and 8% by weight of menthol, such as between 3% and 7% by weight of menthol and for example between 4% and 5.5% by weight of menthol. In one embodiment, the tobacco material includes 4.7% by weight of menthol. Such high levels of menthol loading can be achieved using a high percentage of reconstituted tobacco material, for instance greater than 50% of the tobacco material by weight. Alternatively or additionally, the use of a high volume of aerosol generating material, for instance tobacco material, can increase the level of menthol loading that can be achieved, for instance where greater than about 500 mm3 or suitably more than about 1000 mm3 of aerosol generating material, such as tobacco material, are used.

In the compositions described herein, where amounts are given in % by weight, for the avoidance of doubt this refers to a dry weight basis, unless specifically indicated to the contrary. Thus, any water that may be present in the tobacco material, or in any component thereof, is entirely disregarded for the purposes of the determination of the weight %. The water content of the tobacco material described herein may vary and may be, for example, from 5 to 15% by weight. The water content of the tobacco material described herein may vary according to, for example, the temperature, pressure and humidity conditions at which the compositions are maintained. The water content can be determined by Karl-Fisher analysis, as known to those skilled in the art. On the other hand, for the avoidance of doubt, even when the aerosol forming material is a component that is in liquid phase, such as glycerol or propylene glycol, any component other than water is included in the weight of the tobacco material. However, when the aerosol forming material is provided in the tobacco component of the tobacco material, or in the filler component (if present) of the tobacco material, instead of or in addition to being added separately to the tobacco material, the aerosol forming material is not included in the weight of the tobacco component or filler component, but is included in the weight of the "aerosol forming material" in the weight % as defined herein. All other ingredients present in the tobacco component are included in the weight of the tobacco component, even if of non-tobacco origin (for example non-tobacco fibers in the case of paper reconstituted tobacco).

In an embodiment, the tobacco material comprises the tobacco component as defined herein and the aerosol forming material as defined herein. In an embodiment, the tobacco material consists essentially of the tobacco component as defined herein and the aerosol forming material as defined herein. In an embodiment, the tobacco material consists of the tobacco component as defined herein and the aerosol forming material as defined herein.

Paper reconstituted tobacco is present in the tobacco component of the tobacco material described herein in an amount of from 10% to 100% by weight of the tobacco component. In embodiments, the paper reconstituted tobacco is present in an amount of from 10% to 80% by weight, or 20% to 70% by weight, of the tobacco component. In a further embodiment, the tobacco component consists essentially of, or consists of, paper reconstituted tobacco. In preferred embodiments, leaf tobacco is present in the tobacco component of the tobacco material in an amount of from at least 10% by weight of the tobacco component. For instance, leaf tobacco can be present in an amount of at least 10% by weight of the tobacco component, while the remainder of the tobacco component comprises paper reconstituted tobacco, bandcast reconstituted tobacco, or a combination of bandcast reconstituted tobacco and another form of tobacco such as tobacco granules.

Paper reconstituted tobacco refers to tobacco material formed by a process in which tobacco feedstock is extracted with a solvent to afford an extract of solubles and a residue comprising fibrous material, and then the extract (usually after concentration, and optionally after further processing) is recombined with fibrous material from the residue (usually after refining of the fibrous material, and optionally with the addition of a portion of non-tobacco fibers) by deposition of the extract onto the fibrous material. The process of recombination resembles the process for making paper.

The paper reconstituted tobacco may be any type of paper reconstituted tobacco that is known in the art. In a particular embodiment, the paper reconstituted tobacco is made from a feedstock comprising one or more of tobacco strips, tobacco stems, and whole leaf tobacco. In a further embodiment, the paper reconstituted tobacco is made from a feedstock consisting of tobacco strips and/or whole leaf tobacco, and tobacco stems. However, in other embodiments, scraps, fines and winnowings can alternatively or additionally be employed in the feedstock.

The paper reconstituted tobacco for use in the tobacco material described herein may be prepared by methods which are known to those skilled in the art for preparing paper reconstituted tobacco.

In some examples, the mouthpiece 2 downstream of the aerosol generating material 3 can comprise a wrapper, for instance the first or second plug wraps 7*a*, 7*b*, or tipping paper 11, which comprises an aerosol modifying agent as described herein. The aerosol modifying agent may be disposed on an inwardly or outwardly facing surface of the mouthpiece wrapper. For instance, the aerosol modifying agent may be provided on an area of the wrapper, such as an outwardly facing surface of the tipping paper 11, which comes into contact with the consumer's lips during use. By disposing the aerosol modifying agent on the outwardly facing surface of the mouthpiece wrapper, the aerosol modifying agent may be transferred to the consumer's lips during use. Transfer of the aerosol modifying agent to the consumer's lips during use of the article may modify the organoleptic properties (e.g. taste) of the aerosol generated by the aerosol generating substrate 3 or otherwise provide the consumer with an alternative sensory experience. For example, the aerosol modifying agent may impart flavor to the aerosol generated by the aerosol generating substrate 3. The aerosol modifying agent may be at least partially soluble in water such that it is transferred to the user via the consumer's saliva. The aerosol modifying agent may be one that volatilizes by the heat generated by the aerosol provision system. This may facilitate transfer of the aerosol modifying agent to the aerosol generated by the aerosol generating substrate 3. A suitable sensate material may be a flavor as described herein, sucralose or a cooling agent such as menthol or similar.

A non-combustible aerosol provision device is used to heat the aerosol generating material 3 of the article 1 described herein. The non-combustible aerosol provision device preferably comprises a coil, since this has been found to enable improved heat transfer to the article 1 as compared to other arrangements.

In some examples, the coil is configured to, in use, cause heating of at least one electrically-conductive heating element, so that heat energy is conductible from the at least one electrically-conductive heating element to the aerosol generating material to thereby cause heating of the aerosol generating material.

In some examples, the coil is configured to generate, in use, a varying magnetic field for penetrating at least one heating element, to thereby cause induction heating and/or magnetic hysteresis heating of the at least one heating element. In such an arrangement, the or each heating element may be termed a "susceptor" as defined herein. A coil that is configured to generate, in use, a varying magnetic field for penetrating at least one electrically-conductive heating element, to thereby cause induction heating of the at least one electrically-conductive heating element, may be termed an "induction coil" or "inductor coil".

The device may include the heating element(s), for example electrically-conductive heating element(s), and the heating element(s) may be suitably located or locatable relative to the coil to enable such heating of the heating element(s). The heating element(s) may be in a fixed position relative to the coil. Alternatively, the at least one heating element, for example at least one electrically-conductive heating element, may be included in the article 1 for insertion into a heating zone of the device, wherein the article 1 also comprises the aerosol generating material 3 and is removable from the heating zone after use. Alternatively, both the device and such an article 1 may comprise at least one respective heating element, for example at least one electrically-conductive heating element, and the coil may be to cause heating of the heating element(s) of each of the device and the article when the article is in the heating zone.

In some examples, the coil is helical. In some examples, the coil encircles at least a part of a heating zone of the device that is configured to receive aerosol generating material. In some examples, the coil is a helical coil that encircles at least a part of the heating zone.

In some examples, the device comprises an electrically-conductive heating element that at least partially surrounds the heating zone, and the coil is a helical coil that encircles at least a part of the electrically-conductive heating element. In some examples, the electrically-conductive heating element is tubular. In some examples, the coil is an inductor coil.

In some examples, the use of a coil enables the non-combustible aerosol provision device to reach operational temperature more quickly than a non-coil aerosol provision device. For instance, the non-combustible aerosol provision device including a coil as described above can reach an operational temperature such that a first puff can be provided in less than 30 seconds from initiation of a device heating program, more preferably in less than 25 seconds. In some examples, the device can reach an operational temperature in about 20 seconds from the initiation of a device heating program.

The use of a coil as described herein in the device to cause heating of the aerosol generating material has been found to enhance the aerosol which is produced. For instance, consumers have reported that the aerosol generated by a device including a coil such as that described herein is sensorially closer to that generated in factory made cigarette (FMC) products than the aerosol produced by other non-combustible aerosol provision systems. Without wishing to be bound by theory, it is hypothesized that this is the result of the reduced time to reach the required heating temperature when the coil is used, the higher heating temperatures achievable when the coil is used and/or the fact that the coil enables such systems to simultaneously heat a relatively large volume of aerosol generating material, resulting in aerosol temperatures resembling FMC aerosol temperatures. In FMC products, the burning coal generates a hot aerosol which heats tobacco in the tobacco rod behind the coal, as the aerosol is drawn through the rod. This hot aerosol is understood to release flavor compounds from tobacco in the rod behind the burning coal. A device including a coil as described herein is thought to also be capable of heating aerosol generating material, such as tobacco material described herein, to release flavor compounds, resulting in an aerosol which has been reported to more closely resemble an FMC aerosol.

Using an aerosol provision system including a coil as described herein, for instance an induction coil which heats at least some of the aerosol generating material to at least 200° C., more preferably at least 220° C., can enable the generation of an aerosol from an aerosol generating material that has particular characteristics which are thought to more closely resemble those of an FMC product. For example, when heating an aerosol generating material, including nicotine, using an induction heater, heated to at least 250° C., for a two-second period, under an airflow of at least 1.50 L/m during the period, one or more of the following characteristics has been observed: at least 10 μg of nicotine is aerosolized from the aerosol generating material; the weight ratio in the generated aerosol, of aerosol forming material to nicotine is at least about 2.5:1, suitably at least 8.5:1; at least 100 μg of the aerosol forming material can be aerosolized from the aerosol generating material; the mean particle or droplet size in the generated aerosol is less than about 1000 nm; and the aerosol density is at least 0.1 μg/cc.

In some cases, at least 10 μg of nicotine, suitably at least 30 μg or 40 μg of nicotine, is aerosolized from the aerosol generating material under an airflow of at least 1.50 L/m during the period. In some cases, less than about 200 μg, suitably less than about 150 μg or less than about 125 μg, of nicotine is aerosolized from the aerosol generating material under an airflow of at least 1.50 L/m during the period.

In some cases, the aerosol contains at least 100 μg of the aerosol forming material, suitably at least 200 μg, 500 μg or 1 mg of aerosol forming material is aerosolized from the aerosol generating material under an airflow of at least 1.50 L/m during the period. Suitably, the aerosol forming material may comprise or consist of glycerol.

As defined herein, the term "mean particle or droplet size" refers to the mean size of the solid or liquid components of an aerosol (i.e. the components suspended in a gas). Where the aerosol contains suspended liquid droplets and suspended solid particles, the term refers to the mean size of all components together.

In some cases, the mean particle or droplet size in the generated aerosol may be less than about 900 nm, 800 nm, 700, nm 600 nm, 500 nm, 450 nm or 400 nm. In some cases, the mean particle or droplet size may be more than about 25 nm, 50 nm or 100 nm.

In some cases, the aerosol density generated during the period is at least 0.1 μg/cc. In some cases, the aerosol density is at least 0.2 μg/cc, 0.3 μg/cc or 0.4 μg/cc. In some cases, the aerosol density is less than about 2.5 μg/cc, 2.0 μg/cc, 1.5 μg/cc or 1.0 μg/cc.

The non-combustible aerosol provision device is preferably arranged to heat the aerosol generating material 3 of the article 1, to a maximum temperature of at least 160° C. In some embodiments, the non-combustible aerosol provision device is arranged to heat the aerosol forming material 3 of the article 1, to a maximum temperature of at least about 200° C., or at least about 220° C., or at least about 240° C., such as at least about 270° C., at least once during the heating process followed by the non-combustible aerosol provision device.

Using an aerosol provision system including a coil as described herein, for instance an induction coil which heats at least some of the aerosol generating material to at least 200° C., such as at least 220° C., can enable the generation of an aerosol from an aerosol generating material in an article 1 as described herein that has a higher temperature as the aerosol leaves the mouth end of the mouthpiece 2 than previous devices, contributing to the generation of an aerosol which is considered closer to an FMC product. For instance, the maximum aerosol temperature measured at the mouth-end of the article 1 can preferably be greater than 50° C., such as greater than 55° C. and for example greater than 56° C. or 57° C. Additionally or alternatively, the maximum aerosol temperature measured at the mouth-end of the article 1 can be less than 62° C., such as less than 60° C. and for example less than 59° C. In some embodiments, the maximum aerosol temperature measured at the mouth-end of the article 1 can be between 50° C. and 62° C., such as between 56° C. and 60° C.

Figure 2:
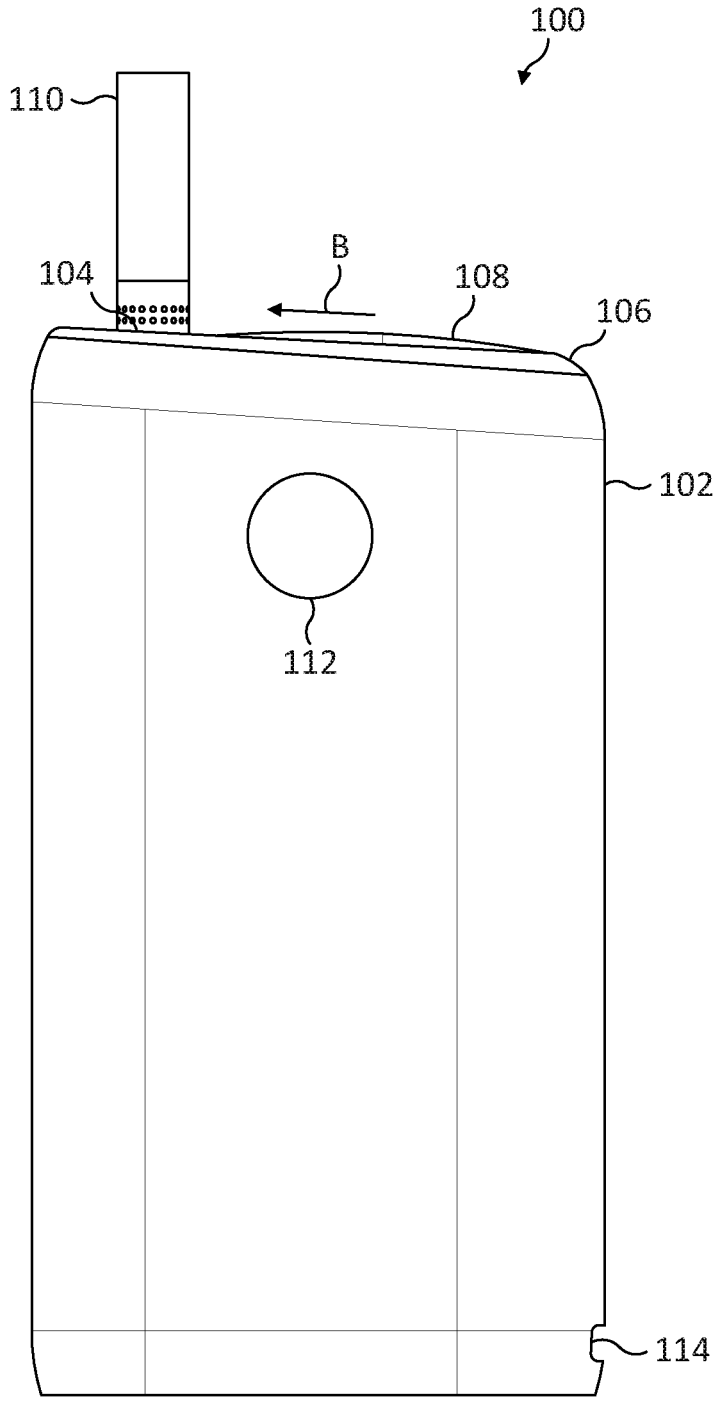
FIG. 2 is a perspective illustration of a non-combustible aerosol provision device for generating aerosol from the aerosol generating material of the articles of FIGS. 1*a* and 1*b*.

FIG. 2 shows an example of a non-combustible aerosol provision device 100 for generating aerosol from an aerosol generating medium/material such as the aerosol generating material 3 of the articles 1 described herein. In broad outline, the device 100 may be used to heat a replaceable article 110 comprising the aerosol generating medium, for instance the articles 1 described herein, to generate an aerosol or other inhalable medium which is inhaled by a user of the device 100. The device 100 and replaceable article 110 together form a system.

The device 100 comprises a housing 102 (in the form of an outer cover) which surrounds and houses various components of the device 100. The device 100 has an opening 104 in one end, through which the article 110 may be inserted for heating by a heating assembly. In use, the article 110 may be fully or partially inserted into the heating assembly where it may be heated by one or more components of the heater assembly.

The device 100 of this example comprises a first end member 106 which comprises a lid 108 which is moveable relative to the first end member 106 to close the opening 104 when no article 110 is in place. In FIG. 2, the lid 108 is shown in an open configuration, however the lid 108 may move into a closed configuration. For example, a user may cause the lid 108 to slide in the direction of arrow "B".

The device 100 may also include a user-operable control element 112, such as a button or switch, which operates the device 100 when pressed. For example, a user may turn on the device 100 by operating the switch 112.

The device 100 may also comprise an electrical component, such as a socket/port 114, which can receive a cable to charge a battery of the device 100. For example, the socket 114 may be a charging port, such as a USB charging port.

Figure 3:
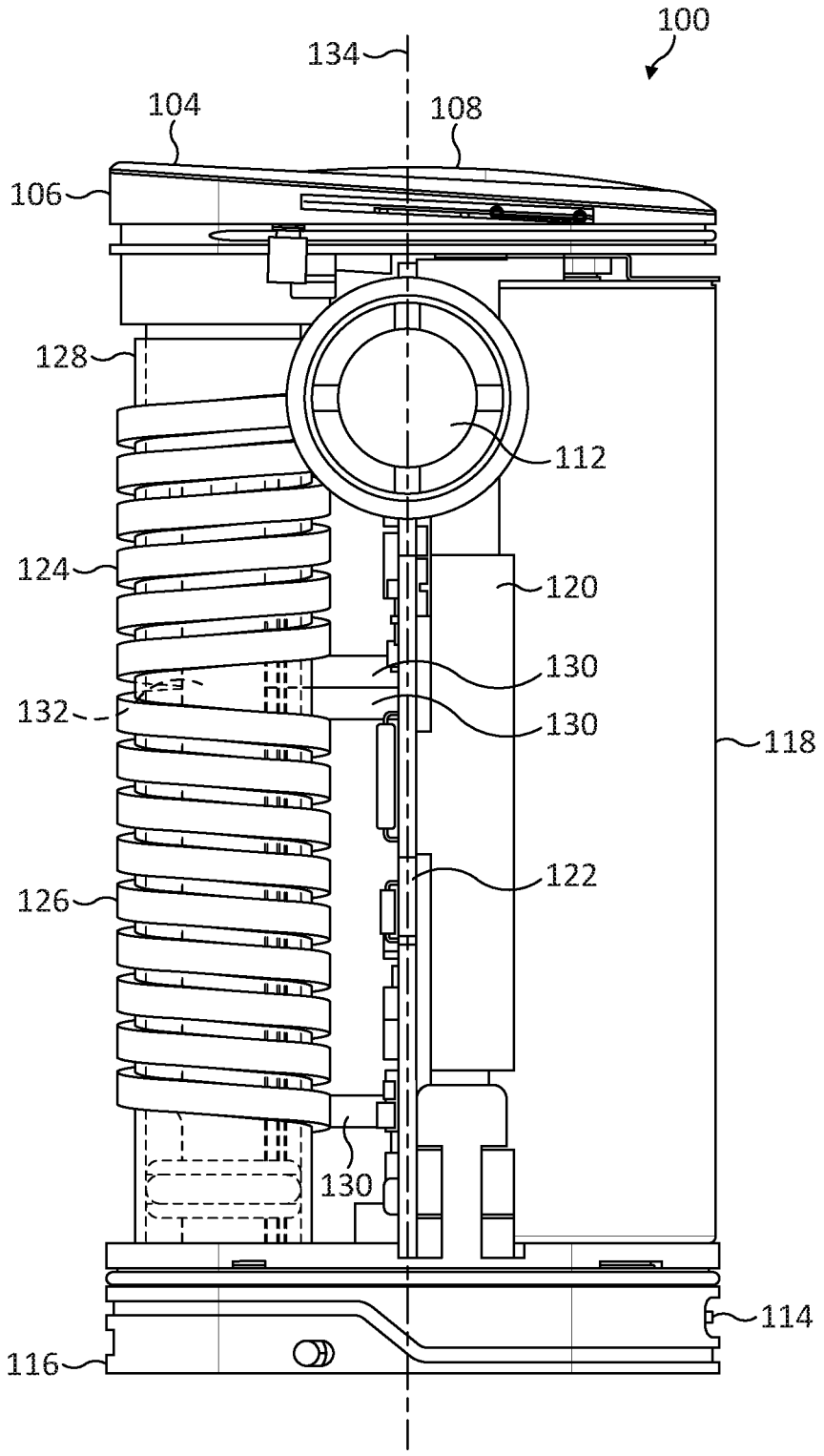
FIG. 3 illustrates the device of FIG. 2 with the outer cover removed and without an article present.

FIG. 3 depicts the device 100 of FIG. 2 with the outer cover 102 removed and without an article 110 present. The device 100 defines a longitudinal axis 134.

As shown in FIG. 3, the first end member 106 is arranged at one end of the device 100 and a second end member 116 is arranged at an opposite end of the device 100. The first and second end members 106, 116 together at least partially define end surfaces of the device 100. For example, the bottom surface of the second end member 116 at least partially defines a bottom surface of the device 100. Edges of the outer cover 102 may also define a portion of the end surfaces. In this example, the lid 108 also defines a portion of a top surface of the device 100.

The end of the device closest to the opening 104 may be known as the proximal end (or mouth end) of the device 100 because, in use, it is closest to the mouth of the user. In use, a user inserts an article 110 into the opening 104, operates the user control 112 to begin heating the aerosol generating material and draws on the aerosol generated in the device. This causes the aerosol to flow through the device 100 along a flow path towards the proximal end of the device 100.

The other end of the device furthest away from the opening 104 may be known as the distal end of the device 100 because, in use, it is the end furthest away from the mouth of the user. As a user draws on the aerosol generated in the device, the aerosol flows away from the distal end of the device 100.

The device 100 further comprises a power source 118. The power source 118 may be, for example, a battery, such as a rechargeable battery or a non-rechargeable battery. Examples of suitable batteries include, for example, a lithium battery (such as a lithium-ion battery), a nickel battery (such as a nickel-cadmium battery), and an alkaline battery. The battery is electrically coupled to the heating assembly to supply electrical power when required and under control of a controller (not shown) to heat the aerosol generating material. In this example, the battery is connected to a central support 120 which holds the battery 118 in place.

The device further comprises at least one electronics module 122. The electronics module 122 may comprise, for example, a printed circuit board (PCB). The PCB 122 may support at least one controller, such as a processor, and memory. The PCB 122 may also comprise one or more electrical tracks to electrically connect together various electronic components of the device 100. For example, the battery terminals may be electrically connected to the PCB 122 so that power can be distributed throughout the device 100. The socket 114 may also be electrically coupled to the battery via the electrical tracks.

In the example device 100, the heating assembly is an inductive heating assembly and comprises various components to heat the aerosol generating material of the article 110 via an inductive heating process. Induction heating is a process of heating an electrically conducting object (such as a susceptor) by electromagnetic induction. An induction heating assembly may comprise an inductive element, for example, one or more inductor coils, and a device for passing a varying electric current, such as an alternating electric current, through the inductive element. The varying electric current in the inductive element produces a varying magnetic field. The varying magnetic field penetrates a susceptor suitably positioned with respect to the inductive element, and generates eddy currents inside the susceptor. The susceptor has electrical resistance to the eddy currents, and hence the flow of the eddy currents against this resistance causes the susceptor to be heated by Joule heating. In cases where the susceptor comprises ferromagnetic material such as iron, nickel or cobalt, heat may also be generated by magnetic hysteresis losses in the susceptor, i.e. by the varying orientation of magnetic dipoles in the magnetic material as a result of their alignment with the varying magnetic field. In inductive heating, as compared to heating by conduction for example, heat is generated inside the susceptor, allowing for rapid heating. Further, there need not be any physical contact between the inductive heater and the susceptor, allowing for enhanced freedom in construction and application.

The induction heating assembly of the example device 100 comprises a susceptor arrangement 132 (herein referred to as "a susceptor"), a first inductor coil 124 and a second inductor coil 126. The first and second inductor coils 124, 126 are made from an electrically conducting material. In this example, the first and second inductor coils 124, 126 are made from Litz wire/cable which is wound in a helical fashion to provide helical inductor coils 124, 126. Litz wire comprises a plurality of individual wires which are individually insulated and are twisted together to form a single wire. Litz wires are designed to reduce the skin effect losses in a conductor. In the example device 100, the first and second inductor coils 124, 126 are made from copper Litz wire which has a rectangular cross section. In other examples the Litz wire can have other shape cross sections, such as circular.

The first inductor coil 124 is configured to generate a first varying magnetic field for heating a first section of the susceptor 132 and the second inductor coil 126 is configured to generate a second varying magnetic field for heating a second section of the susceptor 132. In this example, the first inductor coil 124 is adjacent to the second inductor coil 126 in a direction along the longitudinal axis 134 of the device 100 (that is, the first and second inductor coils 124, 126 to not overlap). The susceptor arrangement 132 may comprise a single susceptor, or two or more separate susceptors. Ends 130 of the first and second inductor coils 124, 126 can be connected to the PCB 122.

It will be appreciated that the first and second inductor coils 124, 126, in some examples, may have at least one characteristic different from each other. For example, the first inductor coil 124 may have at least one characteristic different from the second inductor coil 126. More specifically, in one example, the first inductor coil 124 may have a different value of inductance than the second inductor coil 126. In FIG. 3, the first and second inductor coils 124, 126 are of different lengths such that the first inductor coil 124 is wound over a smaller section of the susceptor 132 than the second inductor coil 126. Thus, the first inductor coil 124 may comprise a different number of turns than the second inductor coil 126 (assuming that the spacing between individual turns is substantially the same). In yet another example, the first inductor coil 124 may be made from a different material to the second inductor coil 126. In some examples, the first and second inductor coils 124, 126 may be substantially identical.

In this example, the first inductor coil 124 and the second inductor coil 126 are wound in opposite directions. This can be useful when the inductor coils are active at different times. For example, initially, the first inductor coil 124 may be operating to heat a first section/portion of the article 110, and at a later time, the second inductor coil 126 may be operating to heat a second section/portion of the article 110. Winding the coils in opposite directions helps reduce the current induced in the inactive coil when used in conjunction with a particular type of control circuit. In FIG. 3, the first inductor coil 124 is a right-hand helix and the second inductor coil 126 is a left-hand helix. However, in another embodiment, the inductor coils 124, 126 may be wound in the same direction, or the first inductor coil 124 may be a left-hand helix and the second inductor coil 126 may be a right-hand helix.

The susceptor 132 of this example is hollow and therefore defines a receptacle within which aerosol generating material is received. For example, the article 110 can be inserted into the susceptor 132. In this example the susceptor 120 is tubular, with a circular cross section.

The susceptor 132 may be made from one or more materials. In some embodiments the susceptor 132 comprises carbon steel having a coating of Nickel or Cobalt.

In some examples, the susceptor 132 may comprise at least two materials capable of being heated at two different frequencies for selective aerosolization of the at least two materials. For example, a first section of the susceptor 132 (which is heated by the first inductor coil 124) may comprise a first material, and a second section of the susceptor 132 which is heated by the second inductor coil 126 may comprise a second, different material. In another example, the first section may comprise first and second materials, where the first and second materials can be heated differently based upon operation of the first inductor coil 124. The first and second materials may be adjacent along an axis defined by the susceptor 132, or may form different layers within the susceptor 132. Similarly, the second section may comprise third and fourth materials, where the third and fourth materials can be heated differently based upon operation of the second inductor coil 126. The third and fourth materials may be adjacent along an axis defined by the susceptor 132, or may form different layers within the susceptor 132. Third material may the same as the first material, and the fourth material may be the same as the second material, for example. Alternatively, each of the materials may be different. The susceptor may comprise carbon steel or aluminum for example.

The device 100 of FIG. 3 further comprises an insulating member 128 which may be generally tubular and at least partially surround the susceptor 132. The insulating member 128 may be constructed from any insulating material, such as plastic for example. In this particular example, the insulating member is constructed from polyether ether ketone (PEEK). The insulating member 128 may help insulate the various components of the device 100 from the heat generated in the susceptor 132.

The insulating member 128 can also fully or partially support the first and second inductor coils 124, 126. For example, as shown in FIG. 3, the first and second inductor coils 124, 126 are positioned around the insulating member 128 and are in contact with a radially outward surface of the insulating member 128. In some examples the insulating member 128 does not abut the first and second inductor coils 124, 126. For example, a small gap may be present between the outer surface of the insulating member 128 and the inner surface of the first and second inductor coils 124, 126.

In a specific example, the susceptor 132, the insulating member 128, and the first and second inductor coils 124, 126 are coaxial around a central longitudinal axis of the susceptor 132.

Figure 4:
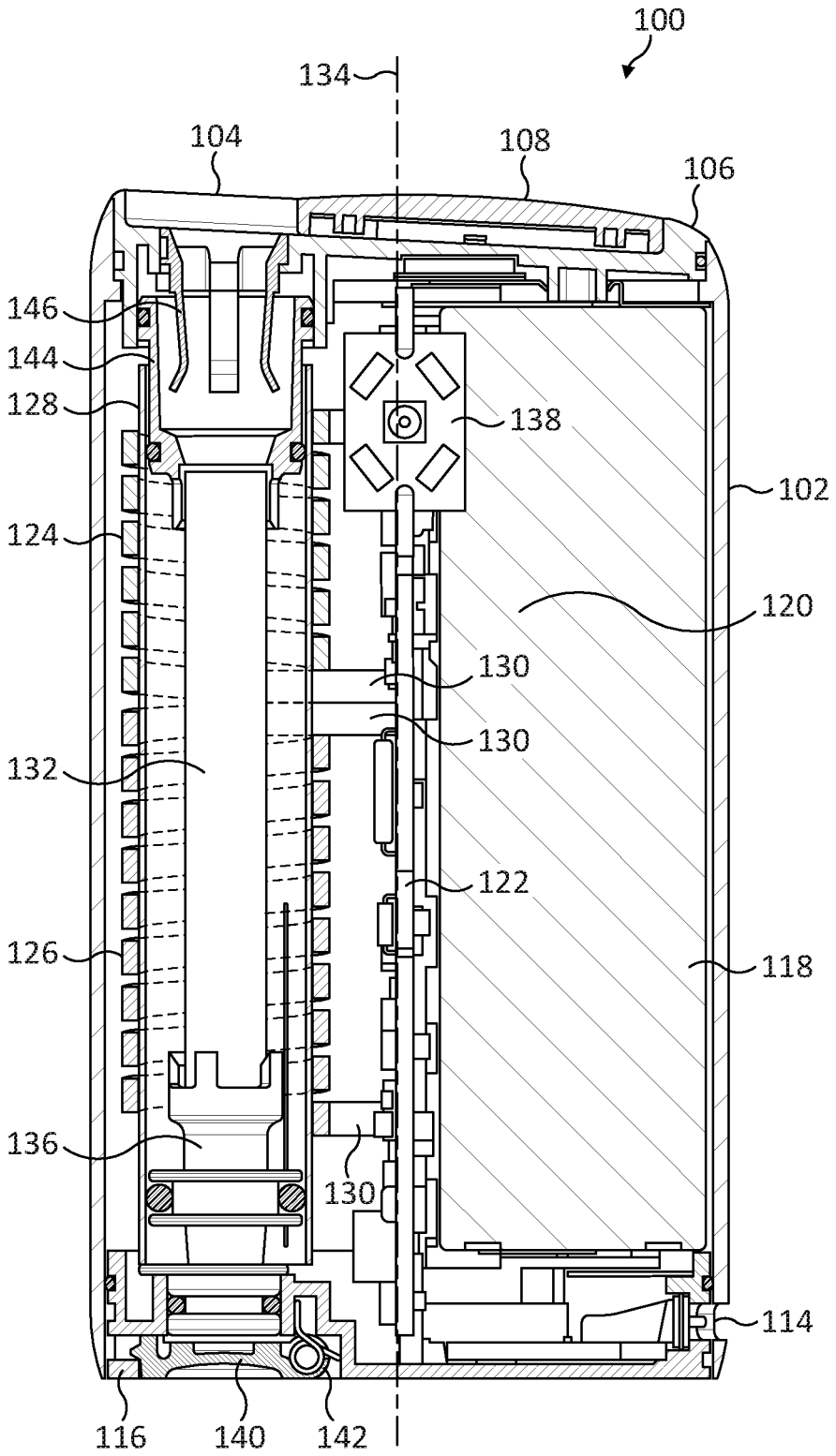
FIG. 4 is a side view of the device of FIG. 2 in partial cross-section.

FIG. 4 shows a side view of device 100 in partial cross-section. The outer cover 102 is present in this example. The rectangular cross-sectional shape of the first and second inductor coils 124, 126 is more clearly visible.

The device 100 further comprises a support 136 which engages one end of the susceptor 132 to hold the susceptor 132 in place. The support 136 is connected to the second end member 116.

The device may also comprise a second printed circuit board 138 associated within the control element 112.

The device 100 further comprises a second lid/cap 140 and a spring 142, arranged towards the distal end of the device 100. The spring 142 allows the second lid 140 to be opened, to provide access to the susceptor 132. A user may open the second lid 140 to clean the susceptor 132 and/or the support 136.

The device 100 further comprises an expansion chamber 144 which extends away from a proximal end of the susceptor 132 towards the opening 104 of the device. Located at least partially within the expansion chamber 144 is a retention clip 146 to abut and hold the article 110 when received within the device 100. The expansion chamber 144 is connected to the end member 106.

Figure 5:
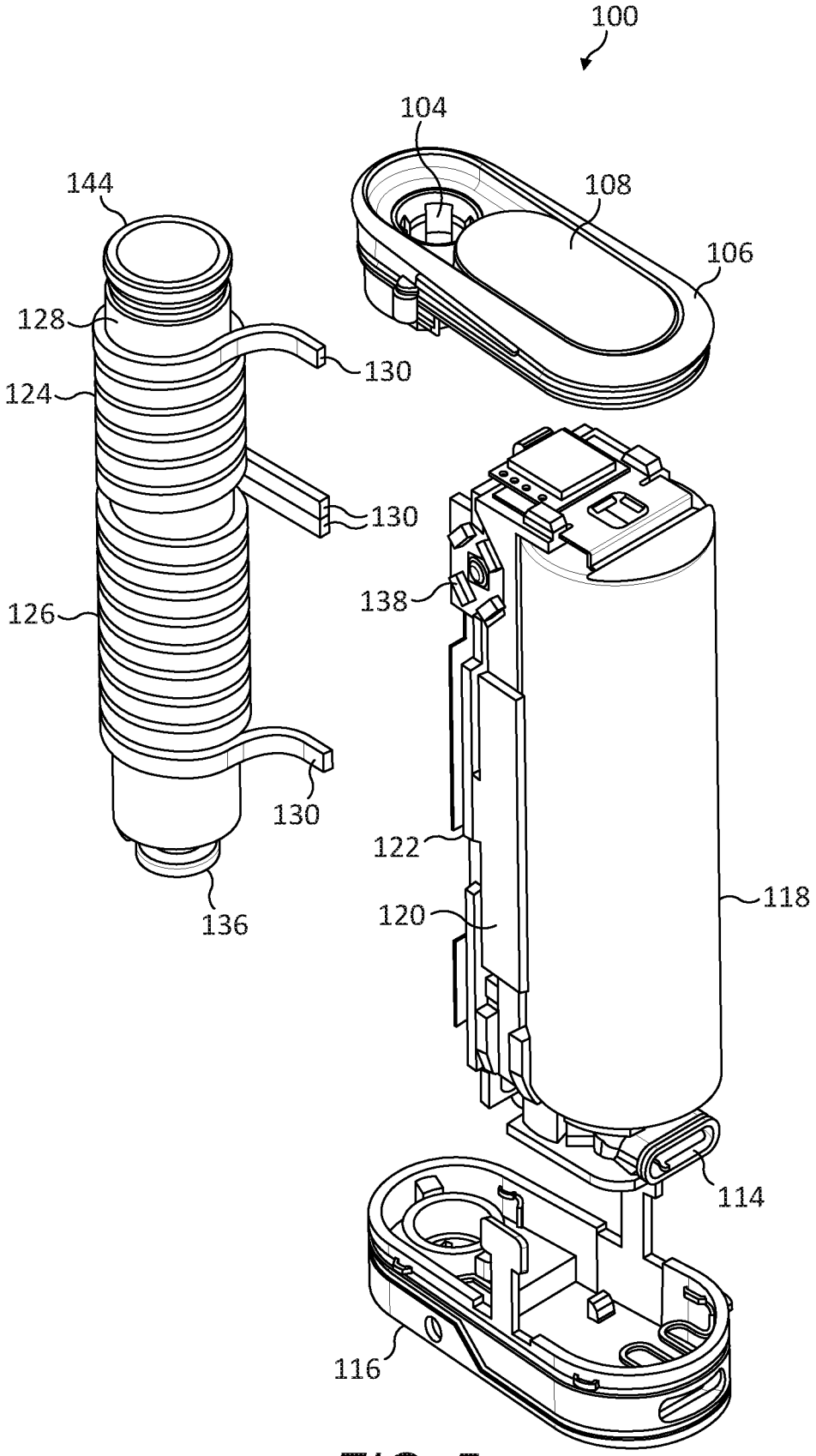
FIG. 5 is an exploded view of the device of FIG. 2, with the outer cover omitted.

FIG. 5 is an exploded view of the device 100 of FIG. 4, with the outer cover 102 omitted.

Figure 6A:
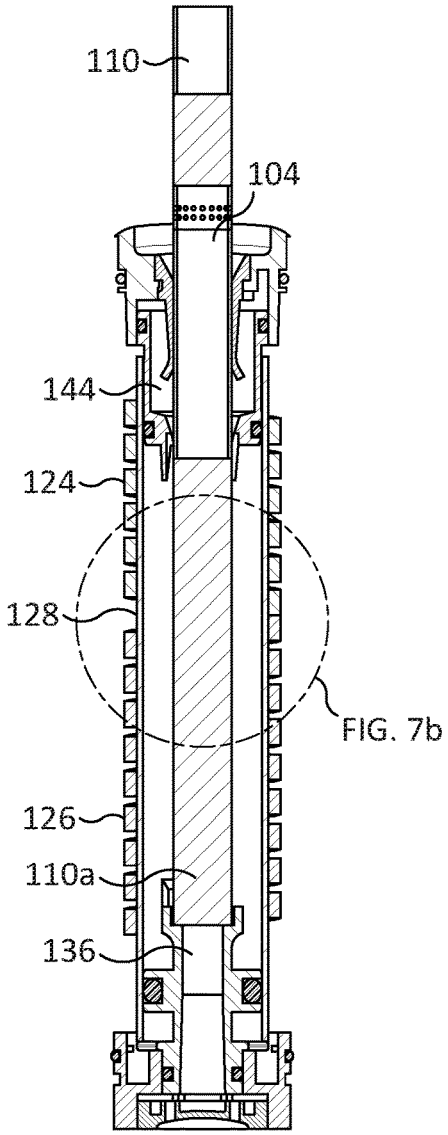
FIG. 6A is a cross sectional view of a portion of the device of FIG. 2.
Figure 6B:
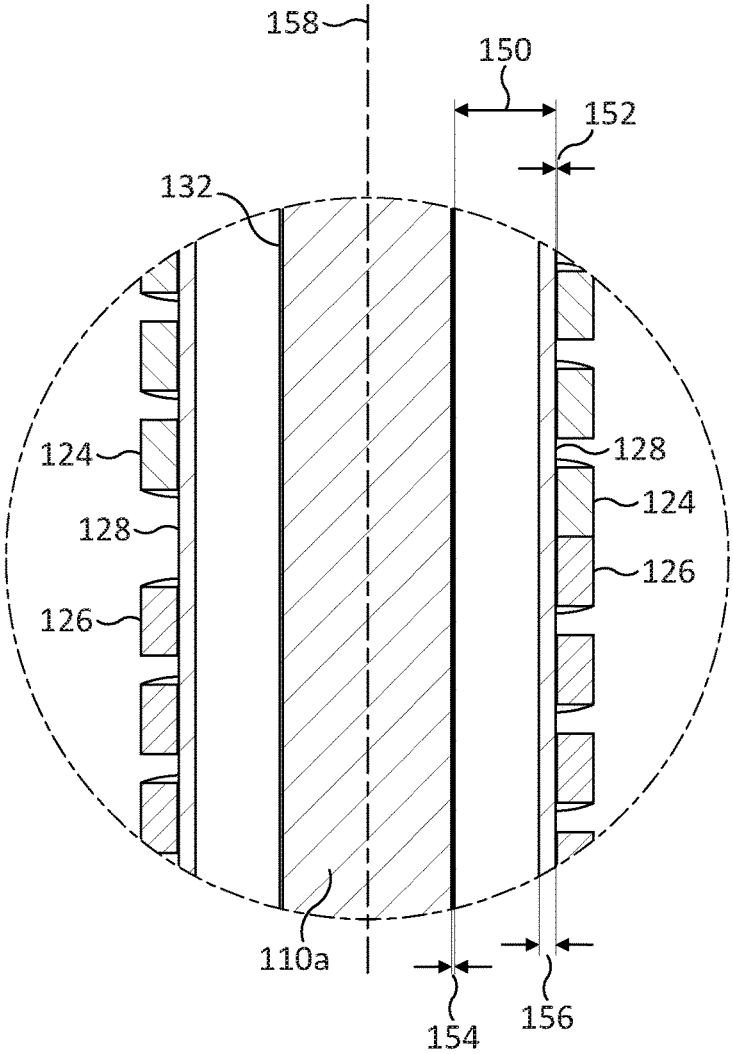
FIG. 6B is a close-up illustration of a region of the device of FIG. 6A.

FIG. 6A depicts a cross section of a portion of the device 100 of FIG. 4. FIG. 6B depicts a close-up of a region of FIG. 6A. FIGS. 6A and 6B show the article 110 received within the susceptor 132, where the article 110 is dimensioned so that the outer surface of the article 110 abuts the inner surface of the susceptor 132. This ensures that the heating is most efficient. The article 110 of this example comprises aerosol generating material 110*a*. The aerosol generating material 110*a* is positioned within the susceptor 132. The article 110 may also comprise other components such as a filter, wrapping materials and/or a cooling structure.

FIG. 6B shows that the outer surface of the susceptor 132 is spaced apart from the inner surface of the inductor coils 124, 126 by a distance 150, measured in a direction perpendicular to a longitudinal axis 158 of the susceptor 132. In one particular example, the distance 150 is about 3 mm to 4 mm, about 3-3.5 mm, or about 3.25 mm.

FIG. 6B further shows that the outer surface of the insulating member 128 is spaced apart from the inner surface of the inductor coils 124, 126 by a distance 152, measured in a direction perpendicular to a longitudinal axis 158 of the susceptor 132. In one particular example, the distance 152 is about 0.05 mm. In another example, the distance 152 is substantially 0 mm, such that the inductor coils 124, 126 abut and touch the insulating member 128.

In one example, the susceptor 132 has a wall thickness 154 of about 0.025 mm to 1 mm, or about 0.05 mm.

In one example, the susceptor 132 has a length of about 40 mm to 60 mm, about 40 mm to 45 mm, or about 44.5 mm.

In one example, the insulating member 128 has a wall thickness 156 of about 0.25 mm to 2 mm, 0.25 mm to 1 mm, or about 0.5 mm.

In use, the articles 1 described herein can be inserted into a non-combustible aerosol provision device such as the device 100 described with reference to FIGS. 2 to 6. At least a portion of the mouthpiece 2 of the article 1 protrudes from the non-combustible aerosol provision device 100 and can be placed into a user's mouth. An aerosol is produced by heating the aerosol generating material 3 using the device 100. The aerosol produced by the aerosol generating material 3 passes through the mouthpiece 2 to the user's mouth.

Figure 7:
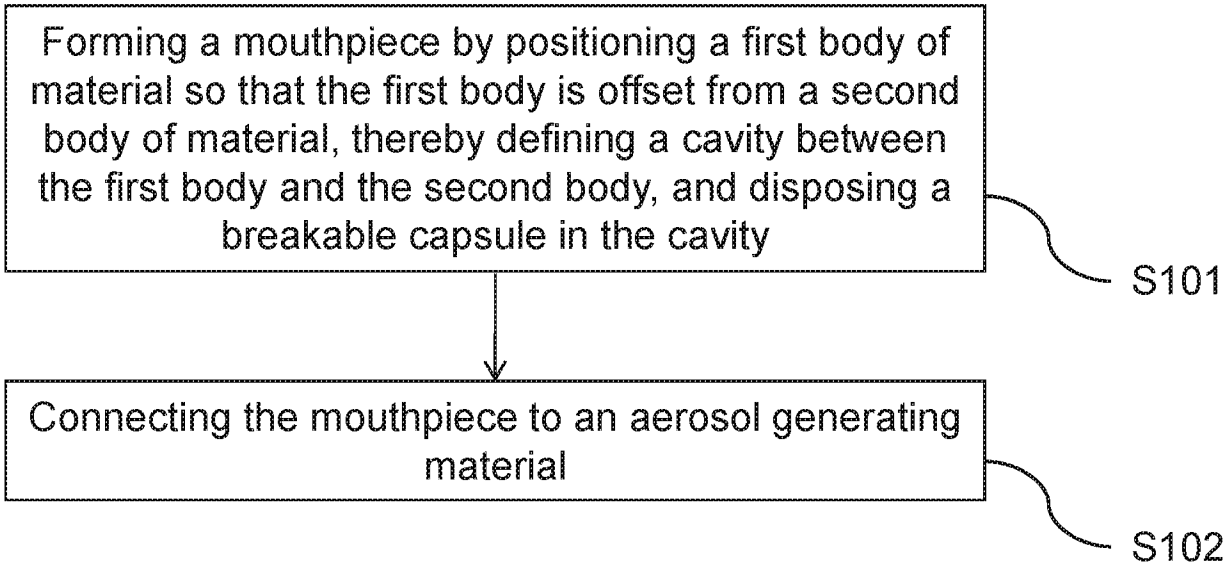
FIG. 7 is a flow diagram illustrating a method of manufacturing an article for use with a non-combustible aerosol provision device.

FIG. 7 illustrates a method of manufacturing an article for use in a non-combustible aerosol provision system.

At 101, a mouthpiece is formed by positioning a first body of material so that the first body is offset from a second body of material, thereby defining a cavity between the first body and the second body, and disposing a breakable capsule in the cavity. A diameter of the capsule is less than the length of the cavity, and the diameter of the cavity is greater than the length of the cavity.

At 102, the mouthpiece is connected to an aerosol generating material.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilized and modifications may be made without departing from the scope of the claimed invention. Various embodiments of the invention may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. An article for use in a non-combustible aerosol provision system, the article comprising:
- an aerosol generating material; and
- a mouthpiece connected to the aerosol generating material, the mouthpiece comprising:
  - a first body of material;
  - a second body of material downstream of the first body, wherein the second body is offset from the first body so as to define a cavity between the first body and the second body; and
  - a breakable capsule disposed in the cavity, wherein a diameter of the capsule is less than a length of the cavity,
  - wherein a diameter of the cavity is greater than the length of the cavity, and
  - wherein the cavity and capsule are arranged such that a transverse range of movement of the capsule is greater than a longitudinal range of movement.

2. The article according to claim 1, wherein the diameter of the cavity is in a range of 3.5 mm to 8 mm.

3. The article according to claim 1, wherein the length of the cavity is in a range of 2 mm to 6 mm.

4. The article according to claim 1, wherein at least one of a length of the first body or a length of the second body is in a range of 4 mm to 8 mm.

5. The article according to claim 1, wherein at least one of the material of the first body or the material of the second body comprises a filamentary tow.

6. The article according to claim 5, wherein the filamentary tow comprises a total denier in a range of 8,000 to 30,000.

7. The article according to claim 5, wherein the filamentary tow comprises a denier per filament in a range of 5 to 12.

8. The article according to claim 1, wherein at least one of the material of the first body or the material of the second body comprises a cellulose based material.

9. The article according to claim 8, wherein at least one of the material of the first body or the material of the second body comprises paper.

10. The article according to claim 8, wherein the cellulose based material comprises a sheet that is at least one of crimped or folded.

11. The article according to claim 10, wherein the sheet has at least one of a basis weight of between 20 and 50 gsm or a width of between 50 mm and 200 mm.

12. The article according to claim 1, wherein the capsule comprises a shell and an aerosol modifying agent enclosed within the shell.

13. The article according to claim 12, wherein the aerosol modifying agent comprises a flavorant.

14. The article according to claim 1, wherein the capsule is substantially spherical in shape.

15. The article according to claim 1, wherein the capsule has a diameter in a range of 2 mm to 4 mm.

16. The article according to claim 1, wherein the aerosol generating material comprises tobacco material.

17. The article according to claim 1, wherein the article is substantially cylindrical in shape.

18. The article according to claim 17, wherein the article has a circumference in a range of 15 mm to 23 mm.

19. The article according to claim 1, further comprising an aerosol cooling section.

20. The article according to claim 1, wherein at least one of the first body or the second body has a pressure drop of between 0.5 and 2 mmWG/mm of length of the at least one of the first body or the second body.

21. A system comprising the article according to claim 1, and a non-combustible aerosol provision device for heating the aerosol generating material of the article.

* * * * *